US006334226B1

(12) United States Patent
Tokunaga et al.

(10) Patent No.: US 6,334,226 B1
(45) Date of Patent: Jan. 1, 2002

(54) FAUCET SUPPORT MEMBER

(75) Inventors: Osamu Tokunaga; Hideyuki Hasebe; Sigemiti Inada, all of Fukuoka (JP)

(73) Assignee: Toto Ltd., Fukuoka (JP)

( * ) Notice: Subject to any disclaimer, the term of this patent is extended or adjusted under 35 U.S.C. 154(b) by 0 days.

(21) Appl. No.: 09/529,968

(22) PCT Filed: Oct. 8, 1998

(86) PCT No.: PCT/JP98/04545

§ 371 Date: Apr. 24, 2000

§ 102(e) Date: Apr. 24, 2000

(87) PCT Pub. No.: WO99/20849

PCT Pub. Date: Apr. 29, 1999

(30) Foreign Application Priority Data

Oct. 22, 1997 (JP) ..... 9-290033
Apr. 7, 1998 (JP) ..... 10-95065

(51) Int. Cl.[7] ..... E03C 1/04

(52) U.S. Cl. ..... 4/675; 4/676; 4/678; 4/695; 4/696

(58) Field of Search ..... 4/675, 676, 677, 4/678, 670, 695, 696; 137/359, 801, 360, 606; 403/373, 187, 199, 408.1, 374.2, 374.5

(56) References Cited

U.S. PATENT DOCUMENTS 3,669,141 A * 6/1972 Schmitt ..... 285/208
4,739,523 A * 4/1988 Bonder ..... 137/801
4,848,395 A 7/1989 Krippendorf
4,927,287 A * 5/1990 Ohkawa et al. ..... 403/408.1
5,050,246 A * 9/1991 Huntoon ..... 4/192
5,465,749 A * 11/1995 Sauter et al. ..... 4/675

FOREIGN PATENT DOCUMENTS

DE 3502953 A1 * 10/1985
EP 0333202 A1 * 9/1989
JP 0231557 A1 * 8/1987
JP 63-312435 12/1988
JP 0020731 A * 1/1990 ..... 4/678
JP 6264479 A * 9/1994 ..... 4/695
JP 8-93012 4/1996
JP 10-168960 6/1998

* cited by examiner

*Primary Examiner*—Gregory L. Huson
*Assistant Examiner*—Khoa Huynh
(74) *Attorney, Agent, or Firm*—Pillsbury Winthrop LLP

(57) ABSTRACT

A faucet support member for fixing a faucet in a mounting hole made in a base plate, comprising tightening members which are fixed to a support seat, which is provided to support a base end portion of the faucet, by connectors so that the tightening members are pivotable with the connectors and slidable along the connectors, and which are formed so that the tightening members can be inserted into the mounting hole when the front end portions thereof are directed inward, and open beyond the diameter of the mounting hole when the front end portions of the tightening members are directed outward; and members for preventing the tightening members, opening beyond the diameter of the mounting hole, from being turned further, the tightening members opening beyond the diameter of the mounting hole being moved toward a bottom surface of the support seat to hold the base plate between the bottom surface of the support seat and an upper surface of the tightening members and support the faucet on the base plate.

31 Claims, 28 Drawing Sheets

FAUCET SUPPORT MEMBER

This application is the national phase of international application PCI/JP98/04545 filed Oct. 8, 1998, which designated the U.S.

TECHNICAL FIELD

The present invention relates to a faucet support member for fixing a faucet on a base plate, such as for a washstand and/or a draining board.

BACKGROUND ART

A faucet support member according to the conventional art is already known as shown In Japanese Laid-open patent No. Sho 63-321435 (1988), wherein bolts are pivotably inserted downward into a support seat which supports the base end portion of the faucet for the purpose of fixing the faucet on a base plate, such as for a washstand and/or draining board, while spirally fixing or screwing a tightening member onto each of the same bolts.

And, when mounting such a faucet support member on the base plate, the tightening members are inserted into a mounting hole which is drilled in the base plate, under the condition that front end portions thereof are directed inward. Then the bolts are turned or rotated while keeping the front end portions of the tightening members directing outward by inserting a finger from an opening of the support seat, thereby shifting or moving the tightening members upward, so as to grip the base plate between the bottom surface of the support seat and the upper surfaces of the tightening members.

DISCLOSURE OF THE INVENTION

In accordance with the present invention, there is provided a faucet support member for fixing a faucet in a mounting hole made in a base plate, comprising: tightening members which are fixed to a support seat, which is provided to support a base end portion of a faucet, by connectors so that the tightening members are pivotable with the connectors and slidable along the connectors, and which are formed so that the tightening members can be inserted into the mounting hole when the front end portions thereof are directed inward, and open beyond the diameter of the mounting hole when the front end portions of the tightening members are directed outward; and members for preventing the tightening members opening beyond the diameter of the mounting hole from being turned further, wherein the tightening members opening beyond the diameter of the mounting hole are moved toward the bottom surface of the support seat to grip the base plate between the bottom surface of the support seat and an upper surface of the tightening members, thereby supporting the faucet on the base plate.

The present invention is characterized in that the members for prevention from turning are provided on the support seat or on the tightening members, and further that a plurality of turning prevention members are detachable.

The present invention is characterized in that the connectors or the turning prevention members are positioned so that external side surfaces of the connectors or the turning prevention members are in contact with an internal surface of the mounting hole when the support seat is fixed at a predetermined position.

The present invention is characterized in that the connectors are bolts, and onto the same connectors are screwed the tightening members.

The present invention is characterized in that a convex portion for holding a water conducting pipe, which is inserted in the support seat, is formed in an opening portion of the support seat, and that the connectors are positioned on the convex portion.

The present invention is characterized in that the tightening members are constructed so that they inhibit the water conducting pipe from being inserted into the opening portion of the support seat when the front ends thereof are directed inward.

The present invention is characterized in that a cover ring is pivotably mounted on an outer periphery of the support seat, while on a peripheral wall of the cover ring a penetrating hole is drilled, into which a fixing member for fixing the base end portion of the faucet onto the support seat can be inserted. Further, the cover ring covers the fixing member with the peripheral wall thereof so as to prevent the fixing member from being shifted in a loosening direction thereof.

The present invention is characterized in that a plurality of the connectors are provided on the support seat, being separated at a distance, and further a spacer is provided on each of the connectors for maintaining the distance.

The present invention is characterized in that the spacer is provided on each of the connectors in a detachable manner, and that the spacer is formed on the support seat in a mountable manner.

The present invention is characterized in that a plurality of the connectors are two bolts, and further that bolt penetrating holes are drilled in the spacer, so as to penetrate the bolts through the bolt penetrating holes, and that nuts are screwed onto the same bolts.

The present invention is characterized in that an insertion bore is drilled on the spacer for inserting the turning prevention members therein.

The present invention is characterized in that a plurality of the connectors are provided being independently pivotable.

The present invention is characterized in that two tightening members are provided, and the inner surfaces of both tightening members are in contact with each other when the front ends of both tightening members are directed inward, that a resistance portion is formed on an upper portion of each of the tightening members, that a buffer member Is attached on an upper portion of each of the tightening members, and that a curved surface is formed on an upper portion of each of the tightening members.

The present invention is characterized in that a guide member is provided on the support seat so that it is in contact with the inner periphery surface of the mounting hole when attaching the support seat onto the base plate. The guide member is constructed so that it is detachable from the support seat and the guide member is constructed with a main body of the guide member and a guide body, and the guide body is detachable from the guide member main body. Further, the guide member is constructed so that it is adjustable at the portion to be attached depending upon a size of the mounting hole.

The present invention is characterized in that an adapter member lies between the support seat and the base end portion of the faucet.

The present invention is characterized in that an upper surface of the front end portion of the each tightening members is inclined toward the base plate while being attached with the connectors by the base end portion thereof.

The faucet support member according to the present invention is for use in fixing a faucet to a base plate, such as on a washstand and/or on a draining board, or on a wall, wherein a mounting hole is drilled in the base plate, into which the faucet support member is mounted, and to the same faucet support member a base end portion of the faucet is fixed, and a flexible hose for use of a handy spray is inserted into an opening portion, which is provided in the same faucet support member.

In the faucet support member, the opening portion Is drilled into a substantially cylinder-like support seat for supporting the base end portion of the faucet, for inserting the hose for use of the handy spray therein, and in the same opening portion are formed convex portions for holding the hose for use of the handy spray, also enabling the insertion into each of the convex portions of a connector, being directed downward and pivotable or rotatable, while screwing tightening members to the same connectors. Also, in the faucet support member, rod-like members for preventing from turning are provided on the bottom surface of the support seat, projecting downward.

The tightening members are formed so that they can be inserted into the mounting hole when their front ends are directed inward, while they open beyond the diameter of opening of mounting hole when their front ends are directed outward.

By turning or rotating the connectors in a clock-wise direction after inserting the tightening members into the mounting hole, under the condition that their front ends are directed inward, the tightening members turn therewith. However they abut on the turning prevention members when they rotate about a half revolution, therefore they can move no further. When the connectors are turned or rotated further under such the condition, the tightening members are moved or shifted upward along the connectors, thereby gripping the base plate between the bottom surface of the support seat and the upper surfaces of the tightening members.

In this manner, with the provision of the turning prevention members for preventing the tightening members from being turned, it is possible to mount the faucet support member to the base plate easily and smoothly from an upper or front side of the base plate, thereby improving workability and safety.

According to the present invention, with the provision of the spacer in the faucet support member, it is possible to keep the distance between the connectors constant, thereby enabling the tight gripping of the base plate between the support seat and the tightening members, and further attaining smooth mounting work of the faucet support member.

With the making of the connectors pivotable or rotatable independently, the connectors neighboring each other do not interfere with one another, so there is no order or sequence in tightening thereof, thereby enabling improvement in the workability thereof.

With the provision of two (2) tightening members, wherein the inner side surfaces of both of the tightening members abut on each other under the condition that the front ends of both tightening members are directed inward, the area of the upper surfaces of the both tightening members are enlarged maximally, thereby increasing the tightening power when mounting the faucet support member onto the base plate.

With the forming of the resistance portion on the upper surface of the tightening members, the resistance portion lies between the tightening members and the base plate for biting into the base plate, thereby providing resistance when the tightening members are turned after being tightened, so as to grip the base plate tightly. Therefore it is possible to mount the faucet support member onto the base plate tightly.

With the forming of curved surfaces on the upper surfaces of the tightening members or the mounting of buffer members on the upper surfaces of the tightening members, it is possible to mitigate the shearing power, which is generated at the base plate on the upper surface of the tightening members when gripping the base plate between the tightening members and the support seat, thereby preventing breakage of or damage to the base plate.

With the provision of the guide members which abut on the inner periphery surface of the mounting hole when mounting the support seat on the base plate, or with such a construction that the guide members are detachable from the support seat, or with constructing the guide member with the guide member main body and the guide body so that the same guide body can be removed from the same guide member main body, and further with such a construction that the guide member can be adjusted at the mounting position thereof depending upon the size of the mounting hole, it is possible to mount the support seat onto the base plate easily, thereby improving workability. And it is also possible to mount the support seat onto mounting holes of different sizes, widening the utility of the support seat.

With the provision of the adopter member between the support seat and the base end portion of the faucet, it is possible to mount faucets of different sizes onto the support seat, and there is no necessity to exchange the support seat even when the faucet is changed to another kind, thereby also widening the utility of the support seat.

When the base end portions of the tightening members are mounted onto the connectors, the upper surfaces at the front end portions thereof are formed to be inclined toward the base plate, it is possible to hold the base plate between the bottom surface of the support seat and at the front end portions of the tightening members tightly, even when a fin or burr of ceramics is formed, thereby improving the mounting strength of the support seat. According to the present invention, a water emitting apparatus is provided, comprising an upper side member, lower side members, and connectors for connecting between the upper side member and said lower side members, in which a base plate having a mounting hole therein is gripped between the upper side member and the lower side members, being fixed to the base plate, wherein: the lower side members are movable to a lower space of said base plate via the mounting hole, and further in the lower space of the base plate, they are movable by operating the connector members, from a position under the mounting hole to a position under a lower surface of the base plate.

The present invention is characterized in that the water emitting apparatus comprises a water emission main body having a water emission opening, and a base seat equipped with the upper side member and the lower side members. And the water emission main body and the base seat are separable from each other.

The present invention is characterized in that the lower side members are constructed so that, in a lower space of the base plate, they are movable from the lower position of said mounting hole to the lower position of the base plate by turning them with the connectors, as axes thereof.

The present invention is characterized in that the relative distance between the upper side member and the lower side members becomes smaller when the connectors are operated.

BEST MODE FOR CARRYING OUT THE INVENTION

Figure 1:
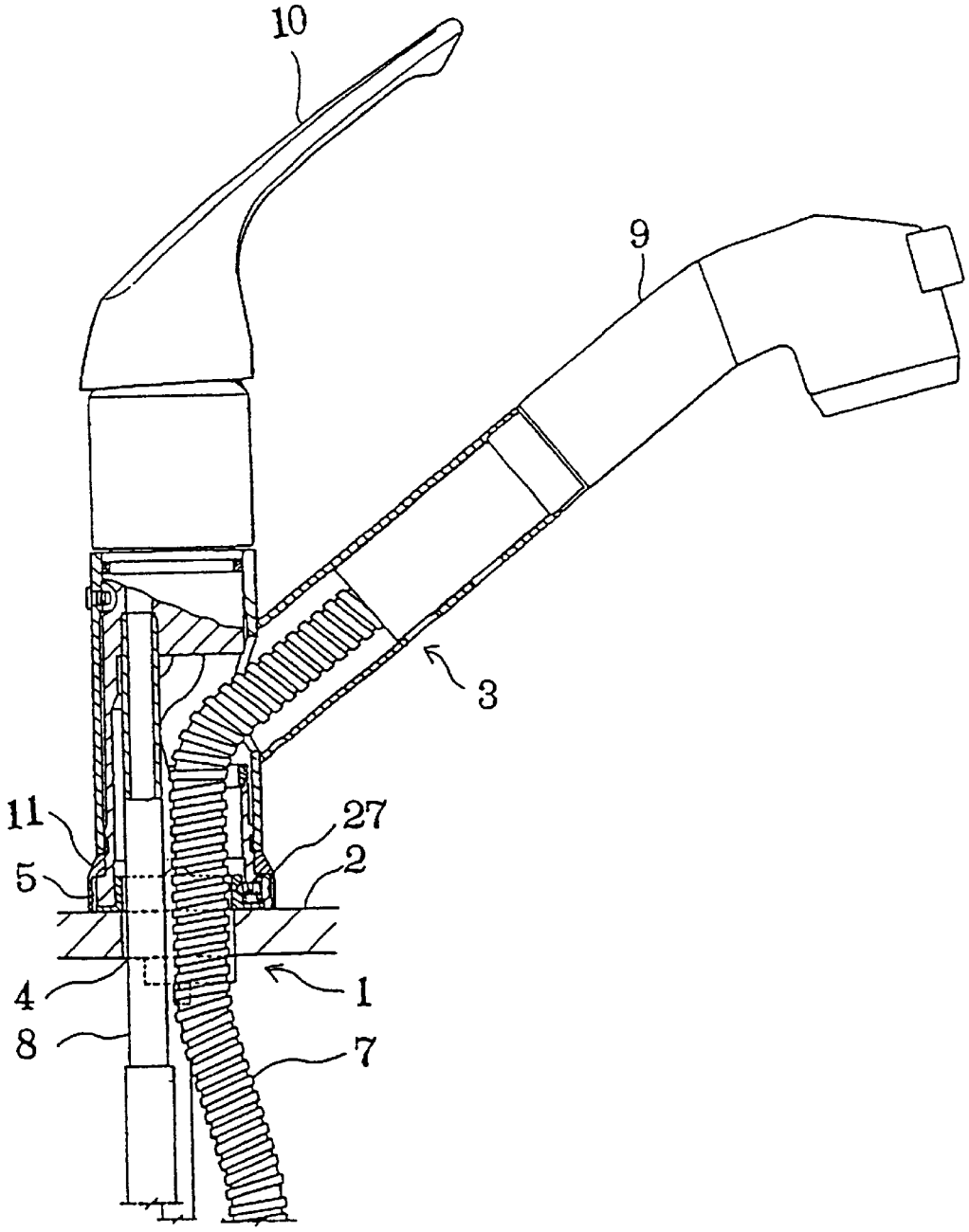
FIG. 1 is a side view of a faucet support member according to the principles of the present invention, showing a condition of use thereof, with certain parts thereof omitted to show other parts better.

FIG. 1 is a view showing a condition of use of a faucet support member according to the present invention, wherein the faucet support member 1 is for use in fixing a faucet 3 to a base plate 2, such as on a washstand and/or on a draining board, etc. Namely, a mounting hole 4 is drilled into the base plate 2, onto which the faucet support member 1 is mounted, and to the same faucet support member 1 a base end portion 5 of the faucet 3 is fixed. Further, a flexible hose 7 for use of a handy spray and axes 8 for operating valves are inserted in an opening portion 6, which is provided in the same faucet support member 1. In the figure, reference numeral 9 indicates the handy spray, 10 an operation lever, and 11 a cover ring.

Figure 4A:
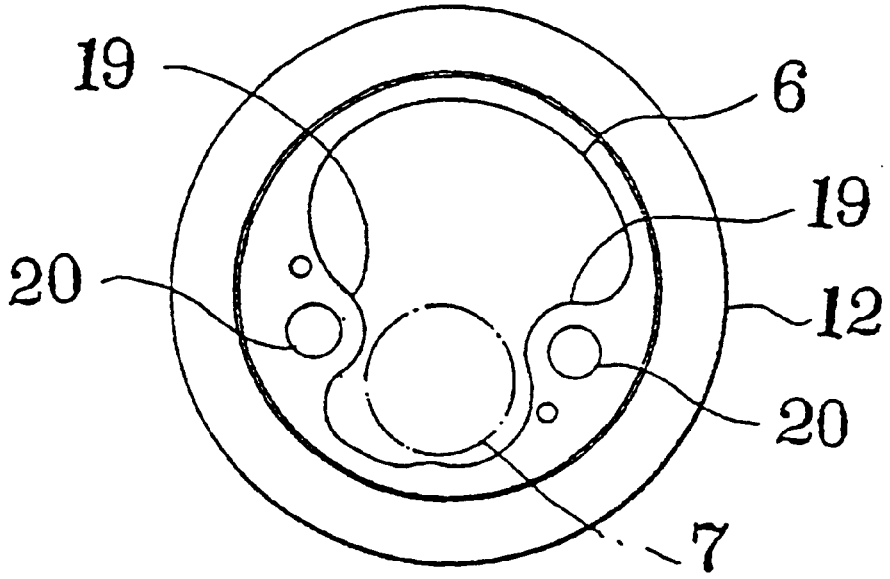
FIGS. 4(A) and (B) are plane veiws of the faucet support member.
Figure 4B:
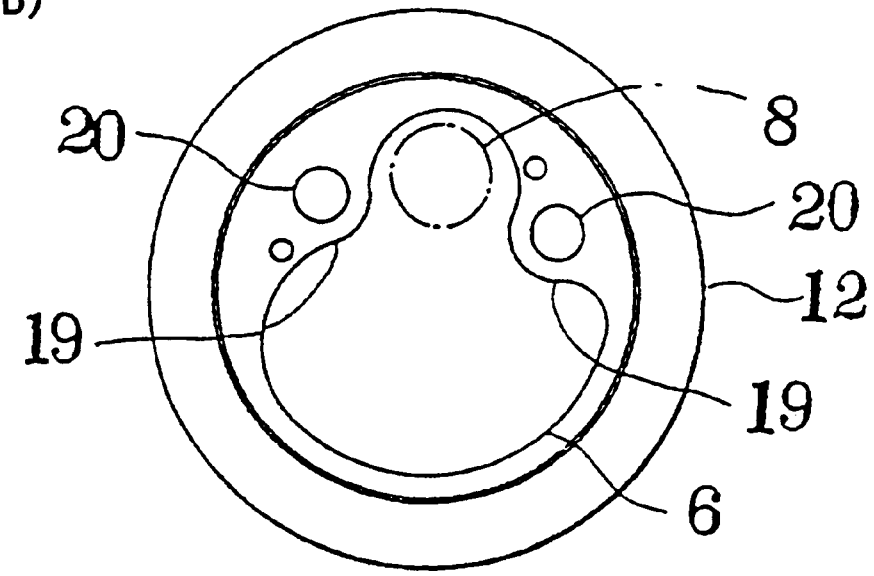

In the faucet support member 1, as shown in FIG. 2, the opening portion 6 is drilled into a substantially cylinder-like support seat 12 for supporting the base end portion 5 of the faucet 3, so as to insert the hose 7 for use of a handy spray and the axes 8 for operating valves therein. In the same opening portion 6, convex portions 19 for holding the hose 7 for use of a handy spray and the axes 8 for operating valves (see FIGS. 4(A) and (B)) are formed. Into each of the convex portions 19 is to be inserted a pivotable or rotatable connector 13 directed downward, for use in screwing tightening members 14 to the same connectors 13. Also, in the faucet support member 1, rod-like turning prevention members 16 are provided on the bottom surface 15 of the support seat 12, projecting downward.

Figure 16:
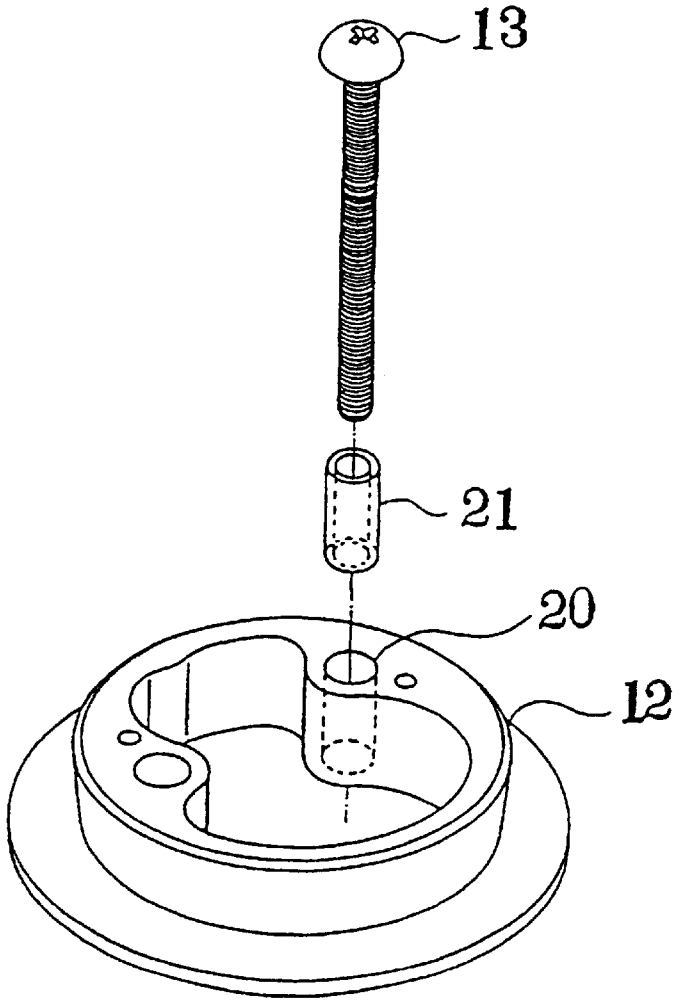
FIG. 16 is a perspective view showing a method of mounting connectors according to the principles of the present invention.

The connectors 13, as shown in FIG. 16, are inserted into insertion bores 20, which are drilled in the support seat 12, through cylinder-like rings 21 for preventing shifting thereof.

Figure 2A:
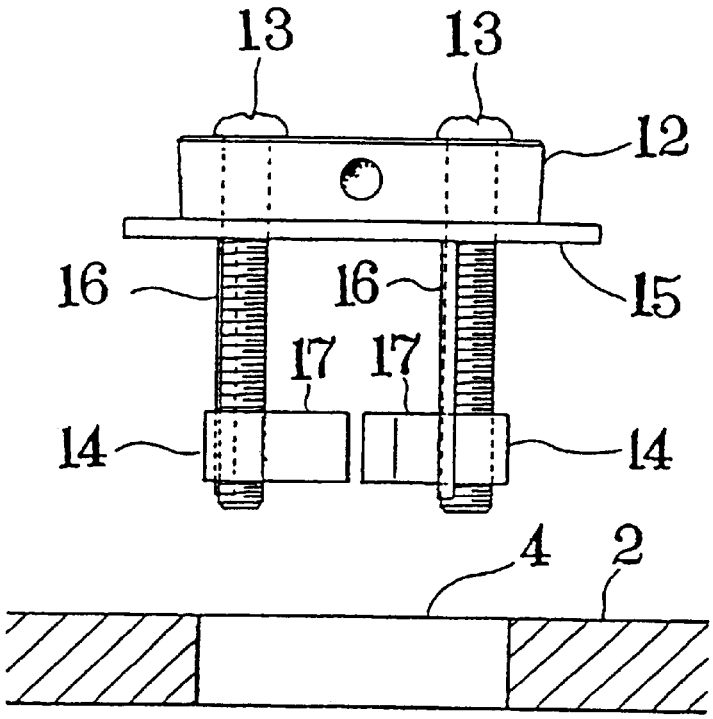
FIGS. 2(A) and (B) are side views showing a method for mounting the faucet support member shown in FIG. 1.
Figure 2B:
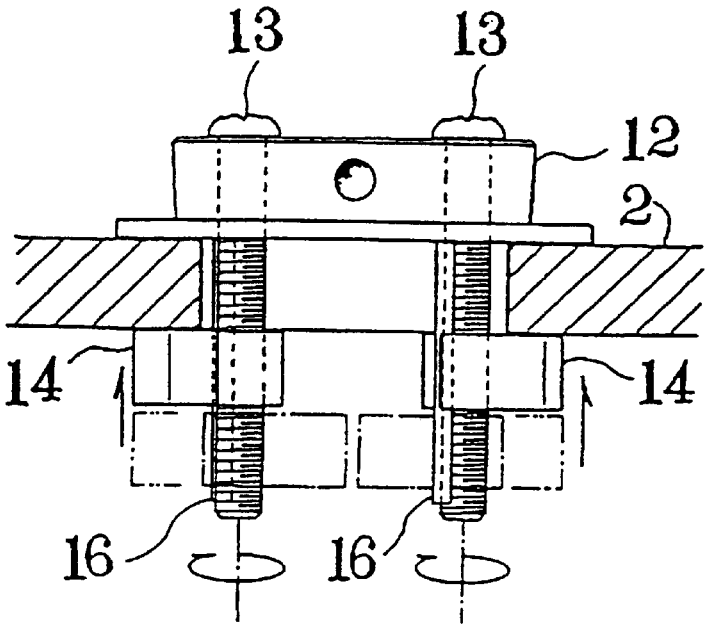
Figure 3A:
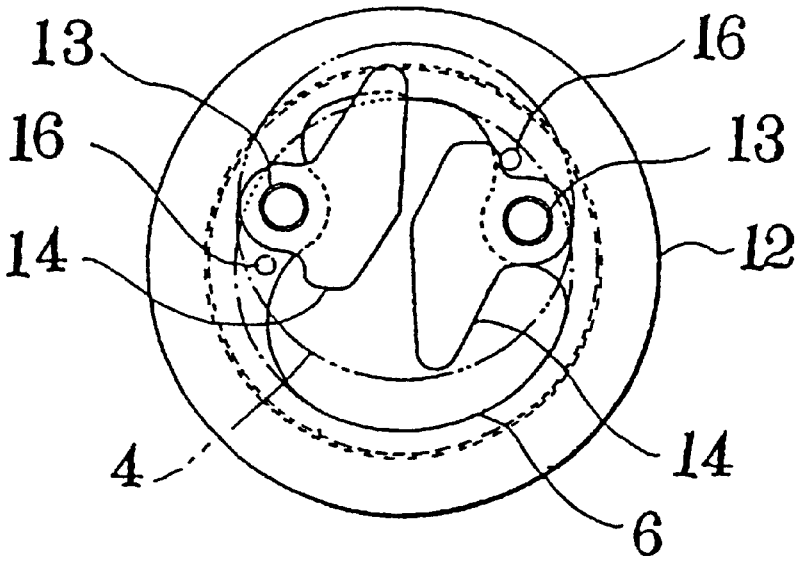
FIGS. 3(A) and (B) are bottom views showing a method for mounting the faucet support member shown in FIG. 1.

The tightening members 14 are formed so that they can be inserted into the mounting hole 4 when their front ends are directed inward (see FIG. 2(A) and FIG. 3(A)). Whereas they expand beyond the diameter of the opening of mounting hole 4 when their front ends are directed outward (see FIG. 2(B) and FIG. 3(B)).

Figure 3B:
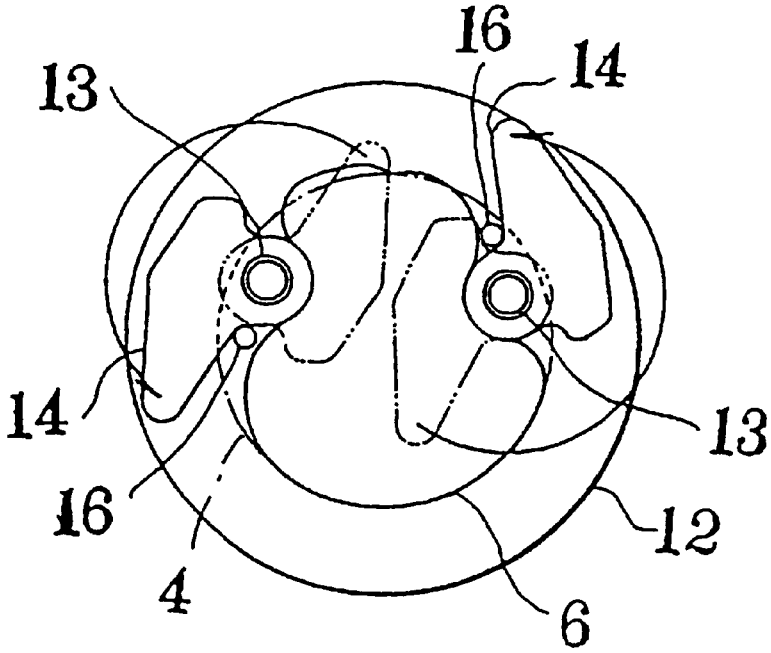

As shown in FIG. 2(A) and FIG. 3(A), the tightening members 14 are inserted into the mounting hole 4 under the condition that their front ends are directed inward. Thereafter, as shown in FIG. 2(B) and FIG. 3(B), by turning or rotating the connectors 13 in a counter-clock-wise direction, the tightening members 14 turn following therewith, however they abut on the turning prevention members 16 when they rotate about half a revolution, thereby being unable to move further (see FIG. 3(B)). When the connectors 13 are turned or rotated further under such a condition, the tightening members 14 are moved or shifted upward along the connectors 13 (see FIG. 2(B)), thereby gripping the base plate 2 between the bottom surface 15 of the support seat 12 and upper surfaces 17 of the tightening members 14. In this manner, it is possible to mount the faucet support member 1 to the base plate 2. Furthermore, concave and convex resistance portions are formed on the upper surfaces 17 of the tightening members 14. Said resistance portions lie between the tightening members 14 and the base plate 2 for biting into the base plate 2, and they provide resistance when the tightening members 14 are screwed after tightening thereof, thereby enabling the tight gripping of the base plate 2.

In this instance, under the condition that the support seat 12 is mounted at a predetermined position on the base plate 2, by disposing a plurality of the connectors 13 or the turning prevention members 16 at the position where the connectors 13 or the turning prevention members 16 abut on the inner periphery of the mounting hole 4, or by otherwise disposing the connectors 13 and the turning prevention members 16, it is possible to make the connectors 13 or the turning prevention members 16 the members for positioning when mounting the faucet support member 1.

In this manner, with the provision of the turning prevention members 16 for preventing the tightening members 14 from being turned, it is possible to mount the faucet support member 1 to the base 2 from an upper side thereof smoothly and easily, thereby improving the workability and safety thereof.

Also, by applying an adhesive on the thread portions of the connectors 13 or on the thread portions of the tightening members 14, or by coating a resin thereon, it is possible to make the tightening members 14 difficult to turn around the connectors 13, thereby guaranteeing that the tightening members 14 turn following the turning of the connectors 13.

Also, by attaching brim bodies at the lower ends of the connectors 13, or by forming such brim bodies by caulking the lower ends of the connectors 13, it is possible to prevent the tightening members 14 from detaching therefrom.

Figure 5:
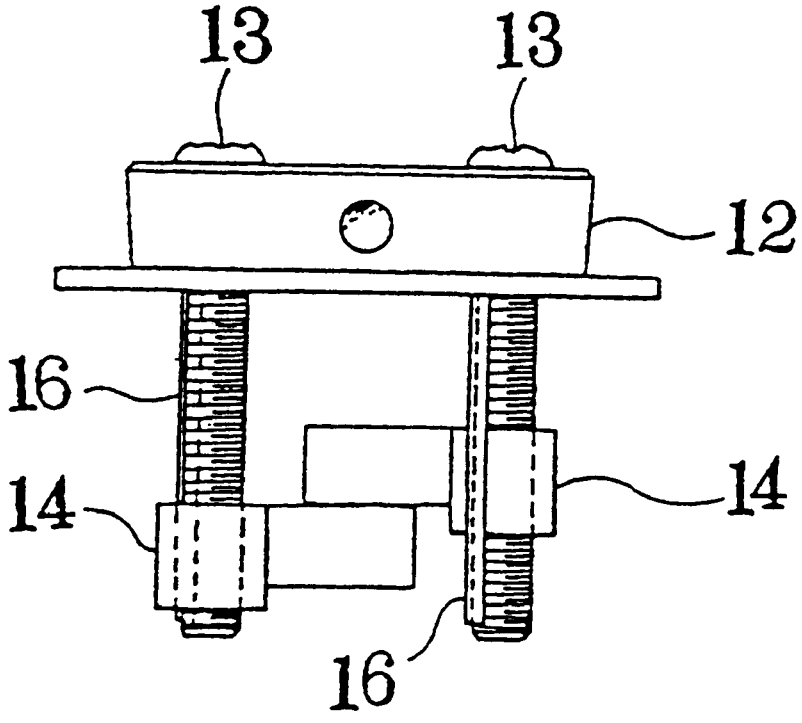
FIG. 5 is a side view of a second embodiment of the faucet support member according to the principles of the present invention.
Figure 6:
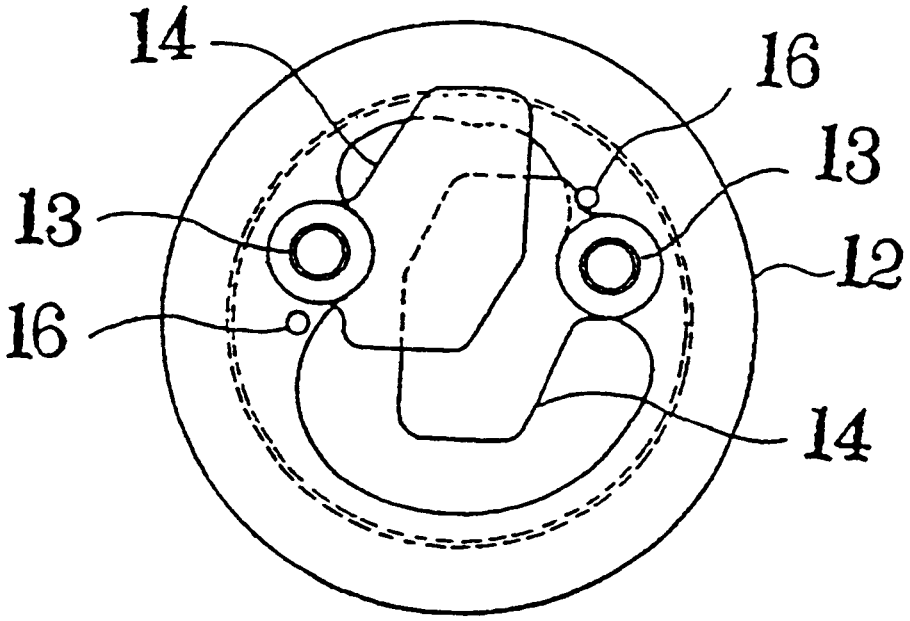
FIG. 6 is a bottom view of a second embodiment of the faucet support member shown in FIG. 5.

FIGS. 5 and 6 show a second embodiment of a faucet support member 1 in which the tightening members 14 at the left-hand side and the right-hand side are disposed or arranged one on top of the other.

By disposing or arranging the tightening members 14 at the left-hand side and the right-hand side one on top of the other, it is possible to enlarge the area of the upper surface 17 of each of the tightening members 14, thereby enabling the tight gripping of the base plate 2 when mounting the faucet support member 1 onto the base plate 2.

Figure 7A:
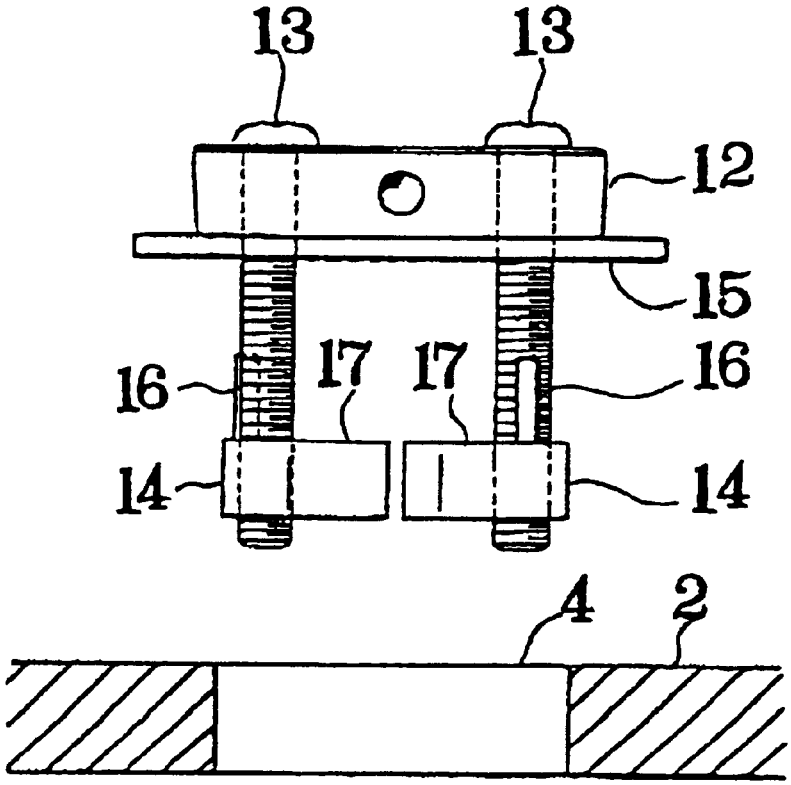
FIGS. 7(A) and (B) are side views showing a third embodiment of a method for mounting the faucet support according to the principles of the present invention.

FIGS. 7(A) and (B) to 9 show a third embodiment of faucet support member 1 in which the turning prevention members 16 are provided on the tightening members 14 by projecting therefrom.

Figure 7B:
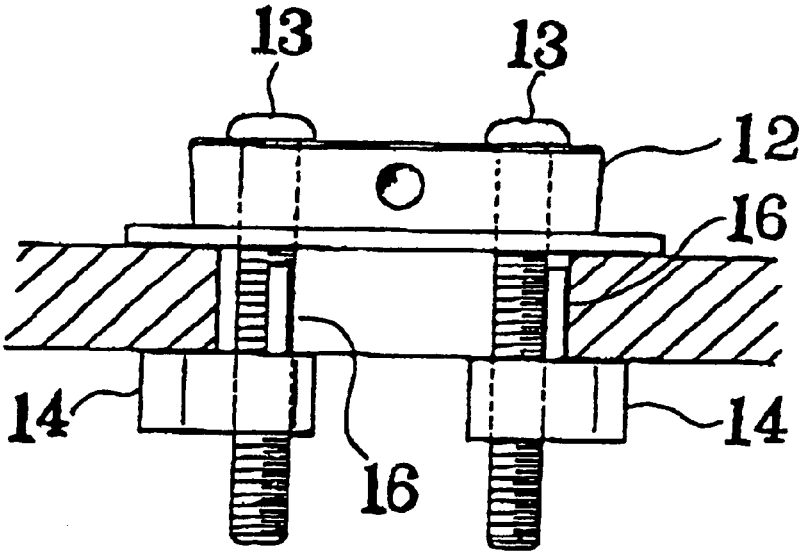
Figure 8A:
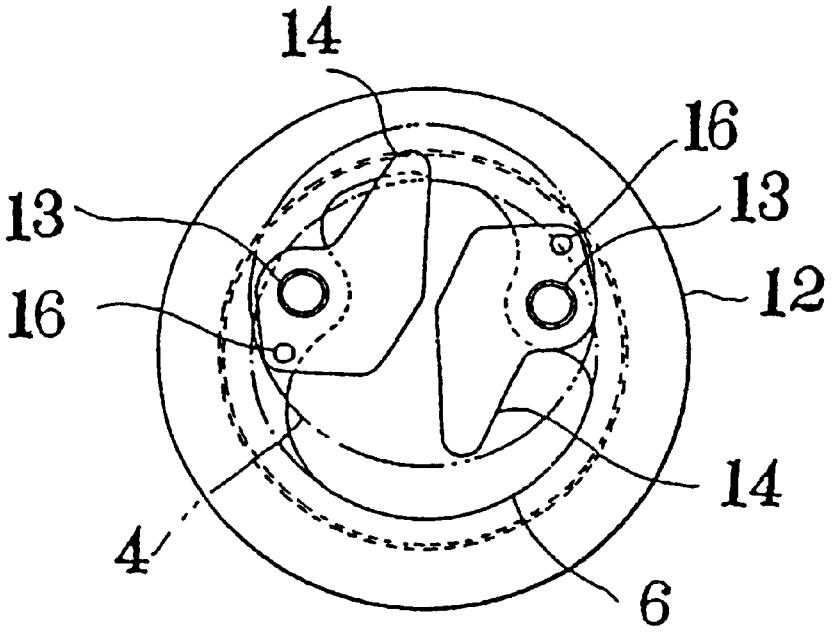
FIGS. 8(A) and (B) are bottom views showing the third embodiment of a method for mounting the faucet support shown in FIGS. 7(A) and 7(B)
Figure 8B:
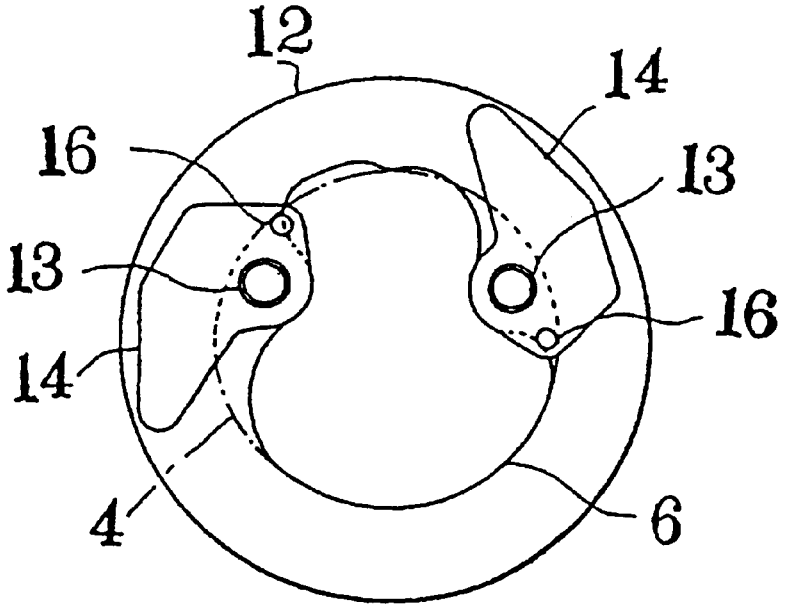
Figure 9:
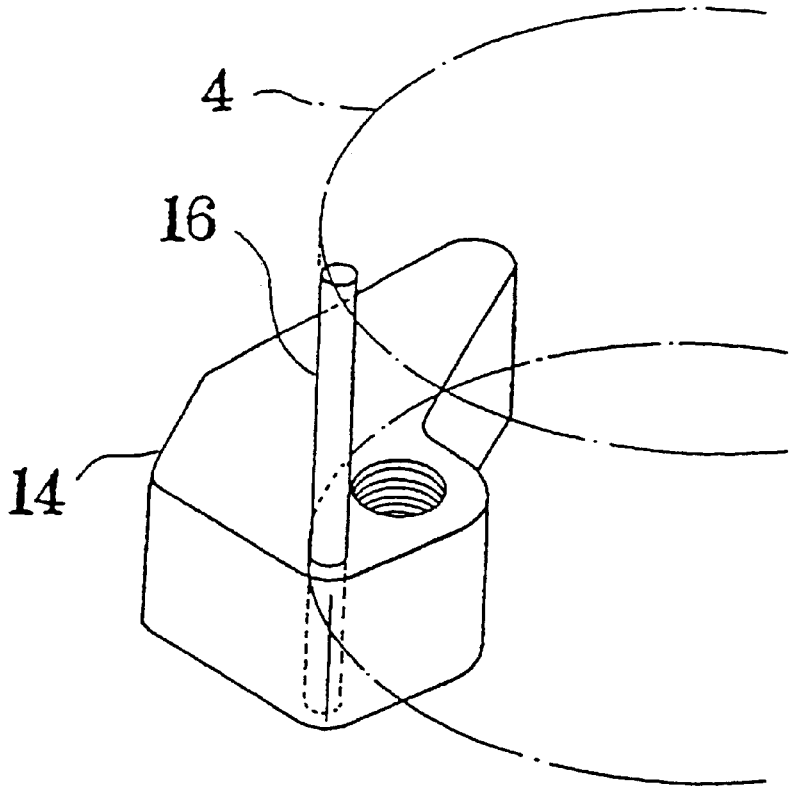
FIG. 9 is a perspective view showing the third embodiment of a method for mounting the faucet support shown in FIGS. 7(A) and 7(B)

And, as shown in FIGS. 7(A) and 8(A), after inserting the tightening members 14 into the mounting hole 4 under the condition where the front ends thereof are directed inward, as shown in FIGS. 7(B) and 8(B), when turning the connectors 13 in the counter clock-wise direction, the tightening members 14 abut on the turning prevention members 16 when they rotate about half a revolution (see FIG. 9), thereby being unable to move further. When the connectors 13 are turned further under such a condition, the tightening members 14 are moved upward along the connectors 13, thereby holding the base plate 2 between the bottom surface 15 of the support seat 12 and the upper surfaces 17 of the tightening members 14.

Figure 10:
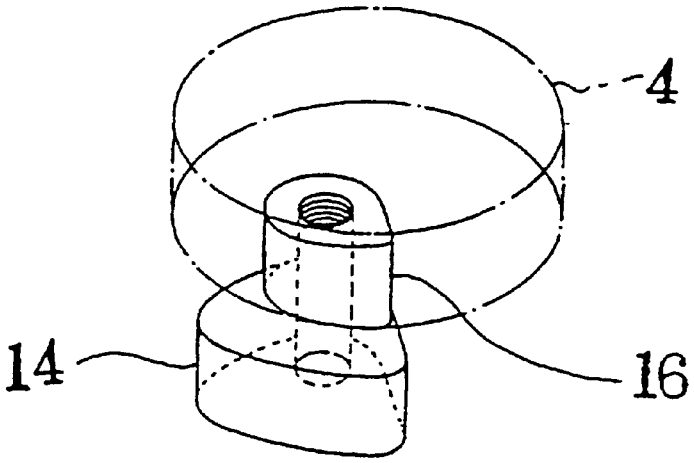
FIG. 10 is a perspective view showing another embodiment of a tightening member according to the principles of the present invention.
Figure 11A:
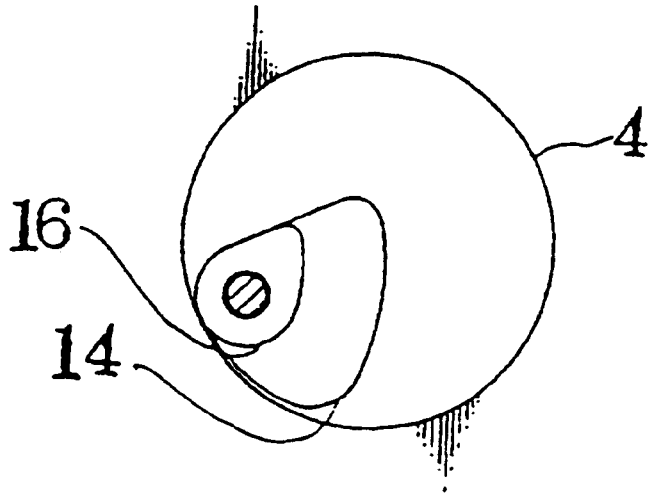
FIGS. 11(A) and (B) are bottom views of the tightening member shown in FIG. 10.
Figure 11B:
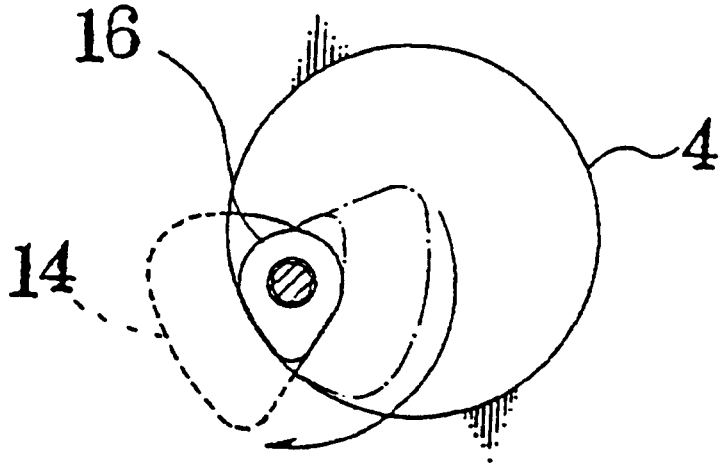

The shape of the turning prevention member 16 should not be restricted to the rod-like shape mentioned above, but may be a cylinder-like shape as shown in FIGS. 10 and 11. In this instance, as shown in the FIG. 11(B), the outer surfaces of the turning prevention members 16 are to be in face-contact with the inner surface of the mounting hole 4.

Also, each turning prevention member 16, as shown in the FIGS. 10 and 11, may be formed with each tightening member 14 as a unit body, or alternatively, may be formed to be detachable from the tightening members 14 or the support seat 12.

By forming the turning prevention member 16 with the tightening member 14 as a unit body, the number of parts is decreased, thereby enabling cheap and easy manufacture of the faucet support member 1.

It is possible to further prevent the turning prevention members 16 from being broken when transporting the faucet support member 1 by making the turning prevention members 16 detachable from the tightening members 14 or the support seat 12, i.e., separating the turning prevention members 16 from the tightening members 14 or the support seat 12 when transporting the faucet support member 1, while attaching the turning prevention members 16 onto the tightening members 14 or the support seat 12 when mounting the faucet support member 1.

Figure 14A:
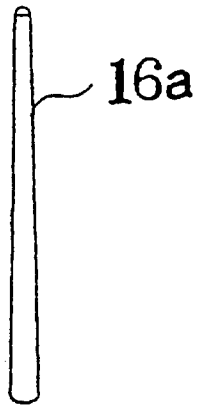
FIGS. 14(A) to (C) are views showing different kinds of turning prevention members for preventing from turning according to the principles of the present invention.
Figure 14B:
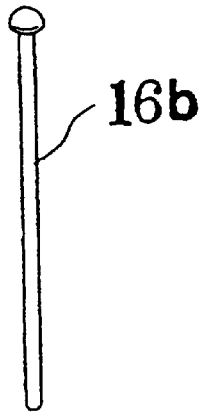
Figure 14C:
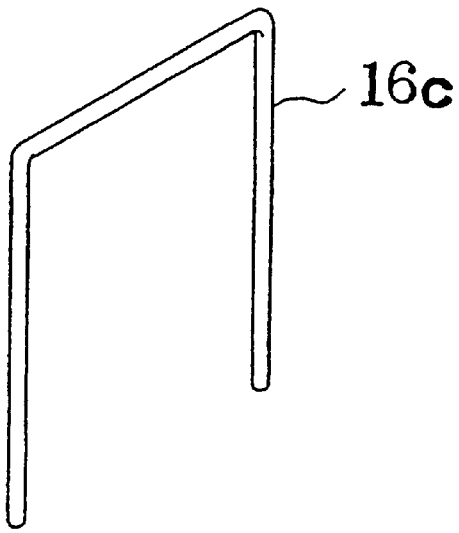
Figure 15:
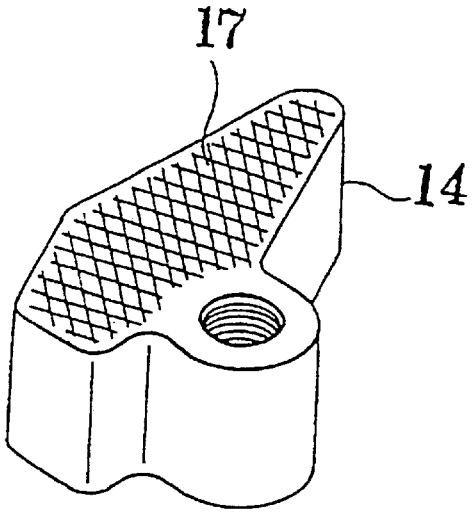
FIG. 15 is a perspective view of a tightening member shown in FIGS. 2(A) and 2(B)

With regard to the turning prevention member 16, being made detachable, various shapes thereof can be considered, such as, as shown in FIG. 14(A), a turning prevention member 16*a,* being formed in a tapered shape, so as to be inserted by suppression from the lower side of the support seat 12. As shown in FIG. 14(B), a turning prevention member 16*b,* at one end of which a brim portion is formed, so as to be inserted from the upper side of the insertion bore 20 drilled on the support seat 12. And as shown in FIG. 14(C), a turning prevention member 16*c,* being formed as a substantially gate-like type by connecting two (2) pieces of the turning prevention members, etc.

Figure 12:
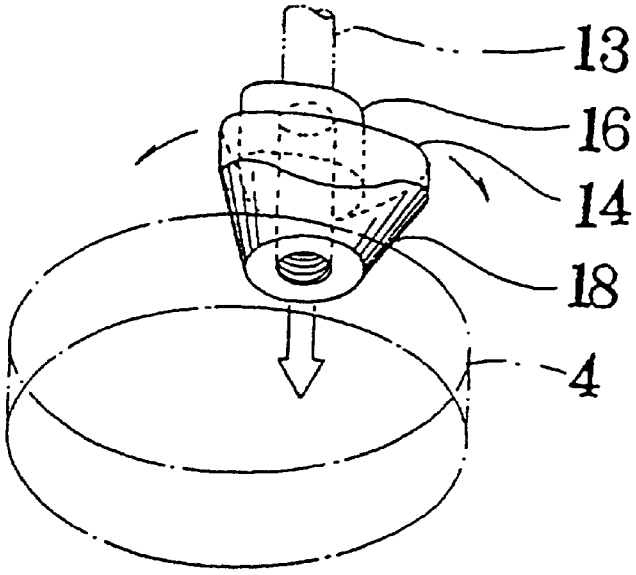
FIG. 12 is a perspective view showing yet another embodiment of a tightening member according to the principles of the present invention.
Figure 13:
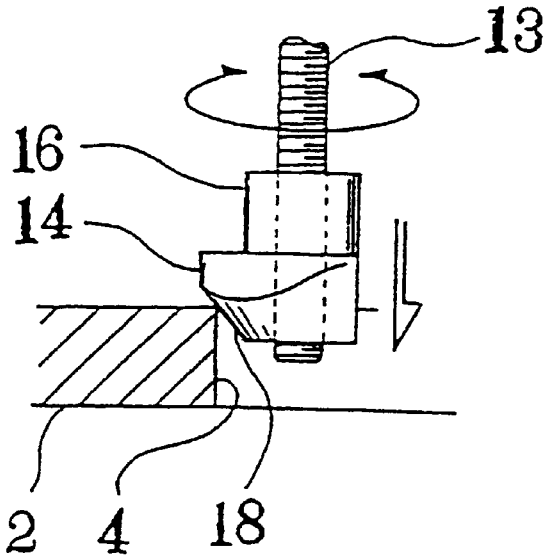
FIG. 13 is a side view of the tightening member shown in FIG. 12.

With regard to the tightening member 14, as shown in FIGS. 12 and 13, being formed with a sloping surface 18 in a tapered shape on a side surface thereof, it is possible to make the front end of the tightening members 14 direct inward when inserting the faucet support member 1 into the mounting hole 4.

Namely, when inserting the faucet support member 1 into the mounting hole 4 under the condition where the front ends of the tightening members 14 are directed outward, the sloping surfaces 18 abut on an inner periphery edge of the mounting hole 4, and when pushing the faucet support member 1 downward, the sloping surfaces 18 of the tightening members 14 are turned along with the inner periphery edge of the mounting hole 4, thereby the front ends are directed inward.

Accordingly, it is possible to bypass time or labor for turning the front ends of tightening members 14 inward in advance when inserting the faucet support member 1 into the mounting hole 4, thereby further improving the workability thereof.

Figure 17A:
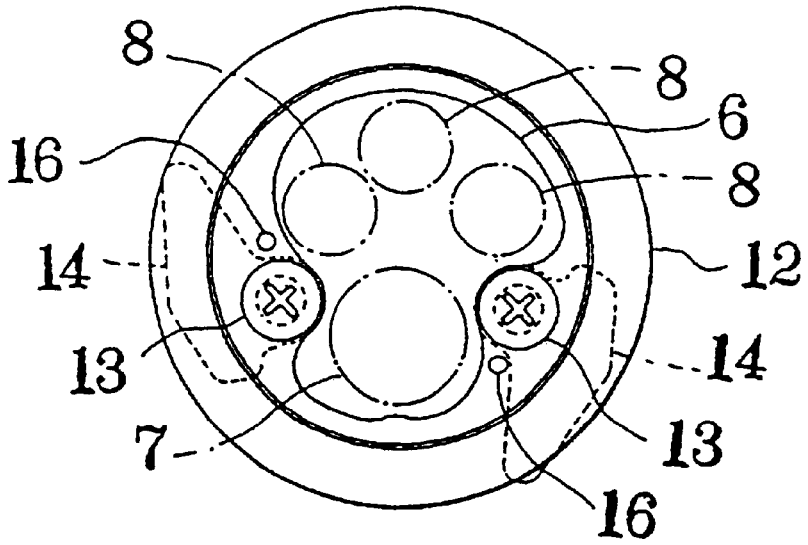
FIGS. 17(A) and (B) are plane views showing conditions of mounting the faucet support member shown in FIG. 1.

Also, the tightening members 14, as shown in FIG. 17(A), are turned to a position where they are hidden by a periphery edge of the opening portion 6, under the condition that they abut on the turning prevention members 16.

Figure 17B:
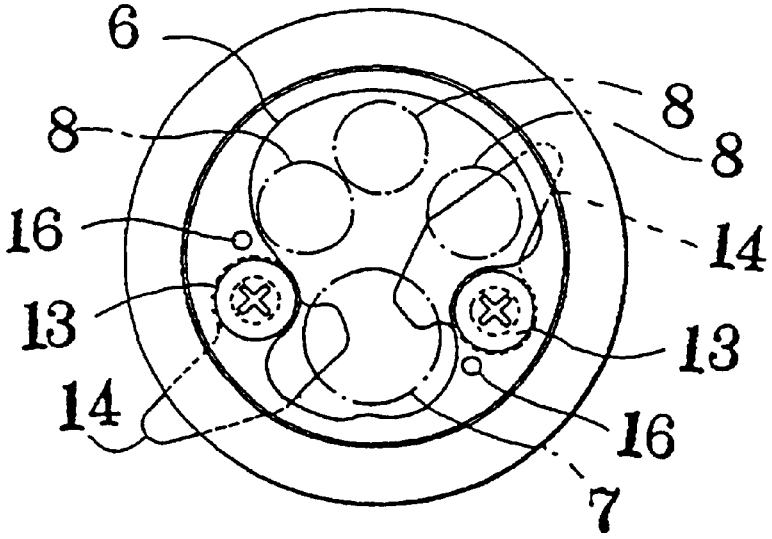

Namely, it is constructed so that the hose 7 for use of a handy spray and the axes for operating valves 8 cannot be inserted into the opening portion 6, until the tightening members 14 are turned to a regular position, which is abutting on the turning prevention members 16, as shown in FIG. 17(B).

Accordingly, when mounting the support seat 12 onto the base plate 2, it is possible to decide whether the tightening members 14 are at the regular position or not, by checking whether the tightening members 14 can be seen from the opening portion 6 with the eye. It is also possible to decide whether the tightening members 14 are at the regular position or not when inserting the hose 7 for use of a handy spray and the axes for operating valves 8 into the opening portion 6.

Figure 22:
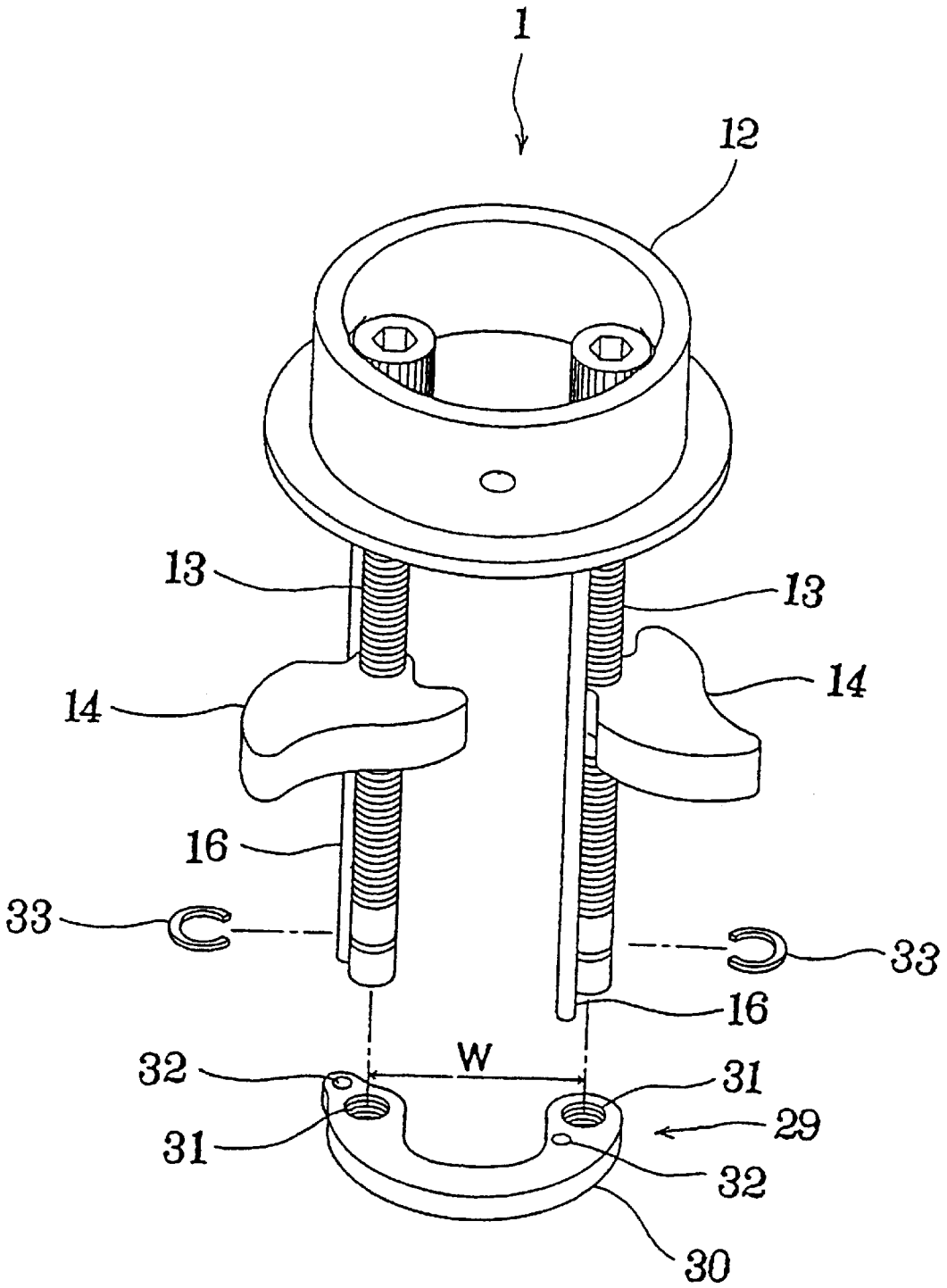
FIG. 22 is a perspective view showing a fourth embodiment of the faucet support member according to the principles of the present invention.

FIG. 22 shows a fourth embodiment of faucet support member 1, wherein bolts as the two (2) connectors 13 are mounted onto the support seat 12, directing downward and being pivotable, in the same manner as in the embodiments mentioned above. Also, the tightening members 14 are screwed onto each of the bolts, and the two (2) turning prevention members 16 are mounted on the bottom surface of the support seat 12 along with the connectors 13. Further, in the present embodiment, at lower end portions of the two (2) connectors 13 is provided a spacer 29 for keeping a distance therebetween.

The spacer 29 is constructed so that insertion bores 31 and 32 are drilled on a substantially arc-like spacer plate 30, for inserting the connectors 13 and the turning prevention members 16 therein, respectively. In the same insertion bores 31 and 32, the lower end portions of the connectors 13 and the lower end portions of the turning prevention members 16, are inserted, wherein below the spacer plate 30, a "C" ring 33 is attached to the connectors 13. However, in place of the "C" ring 33, it is also possible to use a nut, thereby detachably mounting the spacer plate 30 to the connectors 13.

With such a spacer 29, a distance W between the two (2) connectors 13 is held constant. Namely, when gripping the base plate 2 between the support seat 12 and the tightening members 14 by turning the connectors 13, there maybe a case where deformation occurs in the connectors 13 due to an effect of reaction against the tightening, thereby changing the distance between the two (2) connectors 13. Therefore, a desired tightening force cannot be obtained therefrom; however, with the provision of the spacer 29 for the connectors 13, as mentioned above, it is possible to prevent the connectors 13 from being deformed, thereby keeping the distance W between the two (2) connectors 13 constant.

In this manner, with the provision of the spacer 29 in the faucet support member 1, it is possible to keep the distance W between the connectors 13 constant, thereby enabling the tight gripping of the base plate 2 between the support seat 12 and the tightening members 14, further attaining the smooth mounting of the faucet support member 1.

Figure 24:
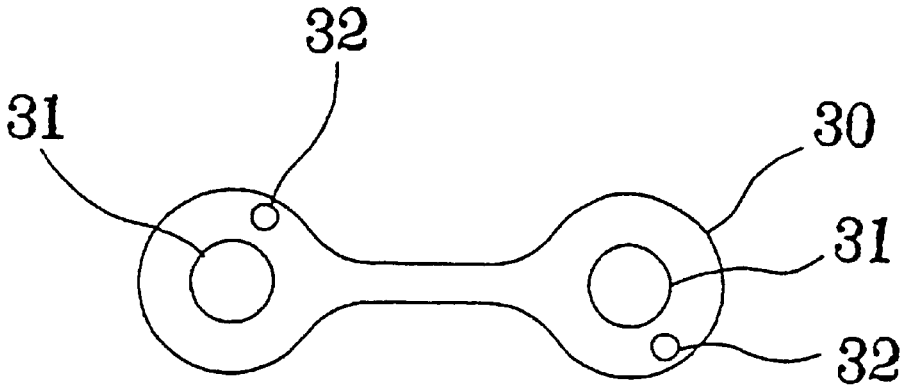
FIG. 24 is a plane view showing a spacer plate of the faucet support member shown in FIG. 23.

However, the shape of the spacer plate 30 may be arc-like as shown in the FIG. 22, with the handy spray hose 7 and the valve operating axes 8 being arranged within the inside of the arc of spacer plate 30. Or spacer plate 30 may be in a long and narrow shape as shown in FIG. 24, the handy spray hose 7 and the valve operating axes 8 being arranged at both sides thereof.

Figure 23:
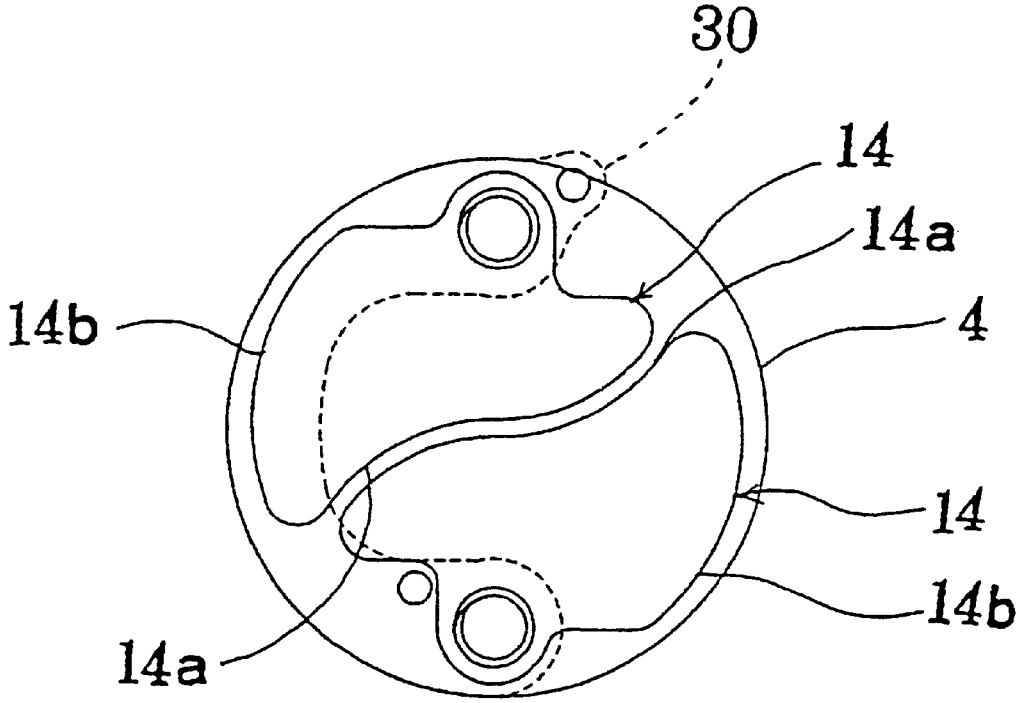
FIG. 23 is a plane view of the fourth embodiment of the faucet support member shown in FIG. 22.

Also in the present embodiment, as shown in FIG. 23, the opening portion of the mounting hole 4 is totally obstructed by the two( 2)tightening members 14 from a plane view thereof. Namely, inner surfaces 14a of the two (2) tightening members 14 are in face-contact with each other, and further the outer side surface 14*b* of the tightening members 14 is formed so as to be along with the shape of the opening portion of the mounting hole 4.

In this manner, the area of the upper surface of the tightening member 14 is enlarged as much as possible, thereby allowing an increase in the tightening force when mounting the faucet support member 1 onto the base plate 2.

Figure 25:
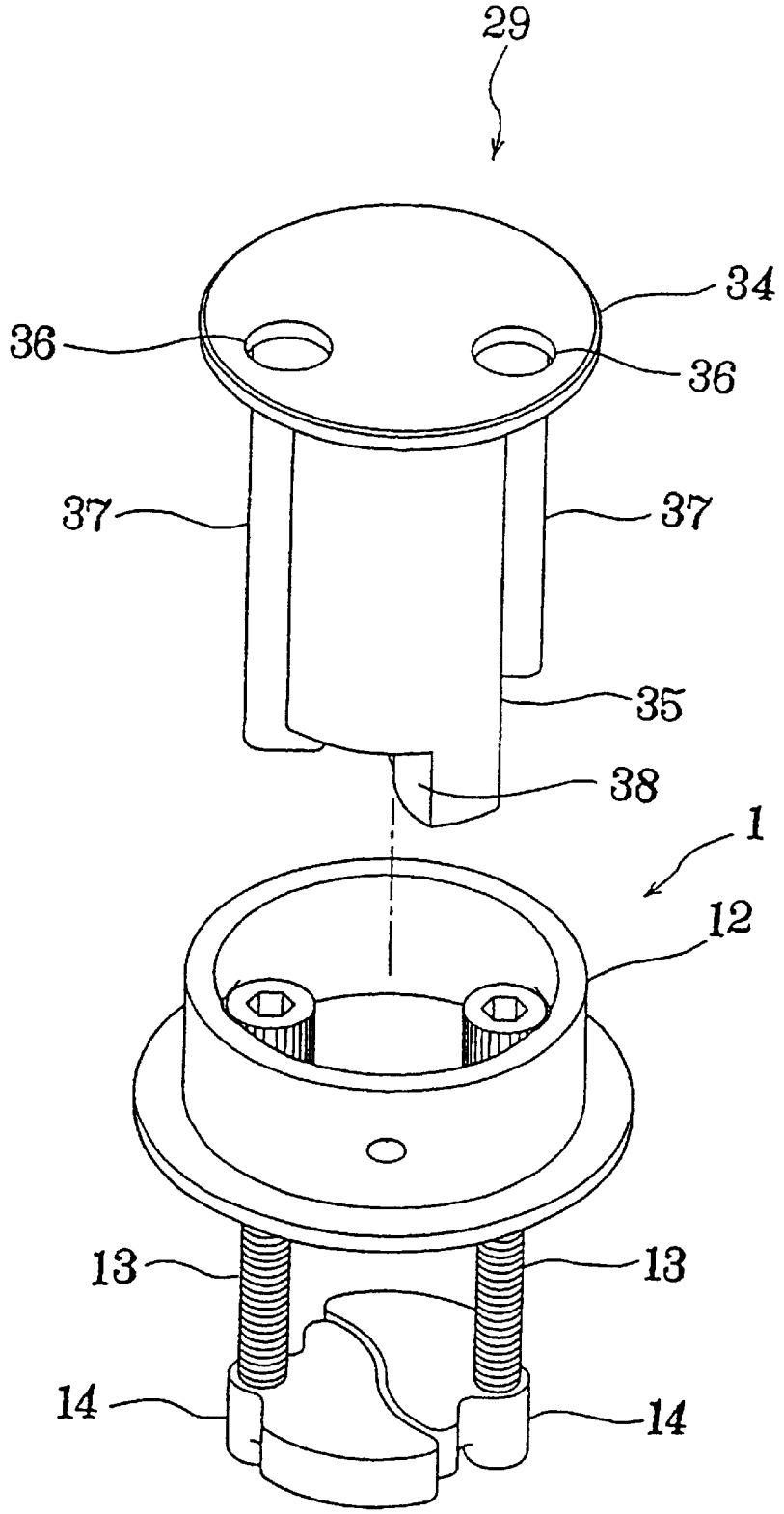
FIG. 25 is a perspective view showing another embodiment of a spacer member; according to the principles of the present invention.
Figure 26:
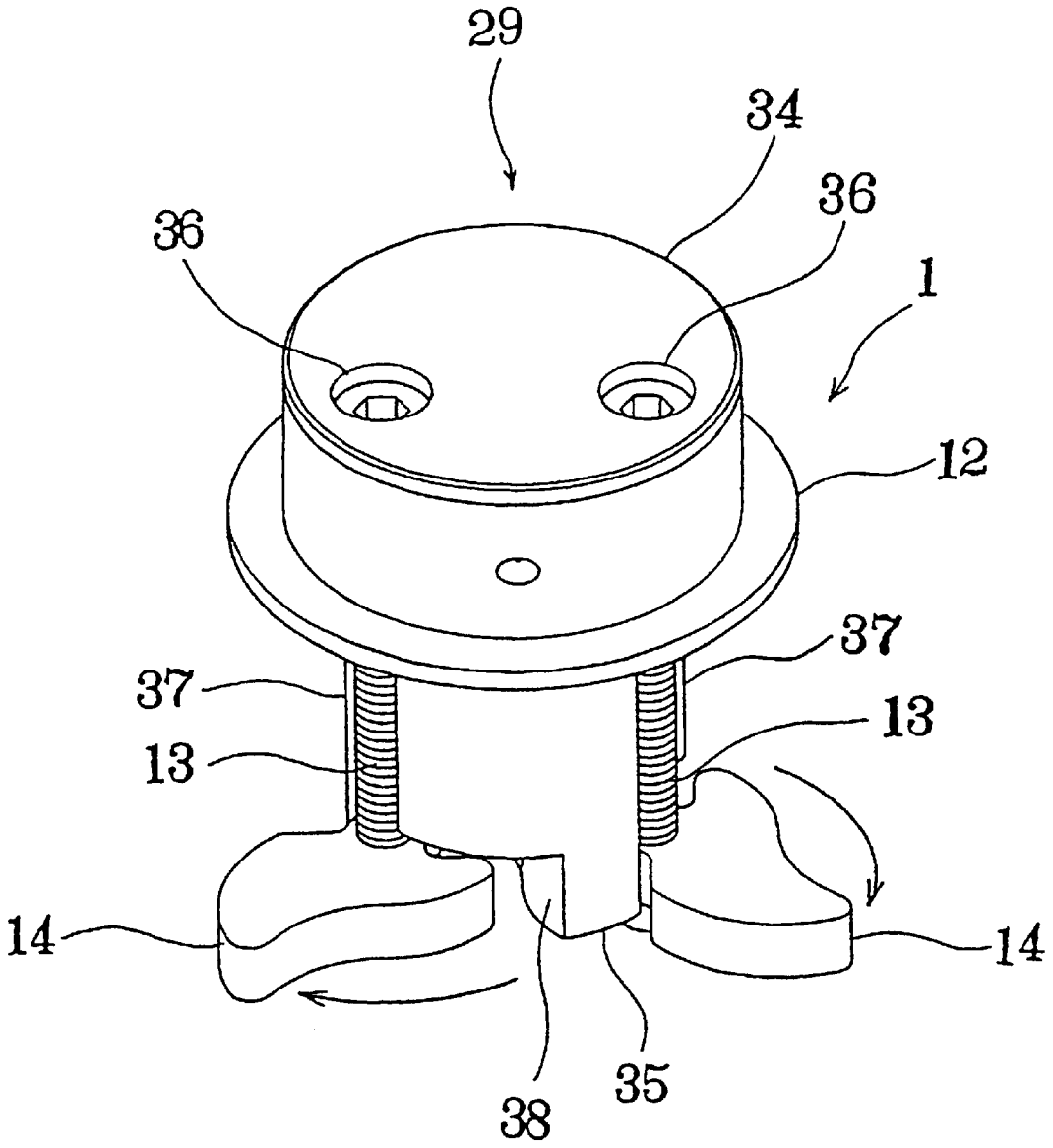
FIG. 26 is a view showing the operation of the spacer member shown in FIG. 25.

FIGS. 25 and 26 show another embodiment of the spacer 29. In this embodiment, the spacer 29 is made detachable from the support seat 12. Namely, the spacer 29 is constructed with a substantially disc-like upper body 34 and a substantially cylinder-like lower body 35 continuing from a lower portion of the same upper body 34. In the upper body 34 penetrating bores 36 for rotating the connectors 13 are drilled. In the lower body 35 gutters 37 are cut at positions, on the periphery surface, corresponding to the connectors 13. Further, concave portions 38 are formed at the lower end of the lower body 35. In the same concave portions 38 the tightening members 14 can be stored under the condition that the front ends thereof are directed inward.

After fitting the tightening members 14 into the support seat 12 from an upper side thereof under the condition that the front ends of the tightening members 14 are directed inward, by turning the connectors 13, the tightening members 14, expand directing outward, then move in an upward direction along the gutters 37.

In that instance, the tightening members 14 are moved upward, being guided by the gutters 37. Therefore, the spacer 29 functions as the turning prevention members 16.

Figure 27:
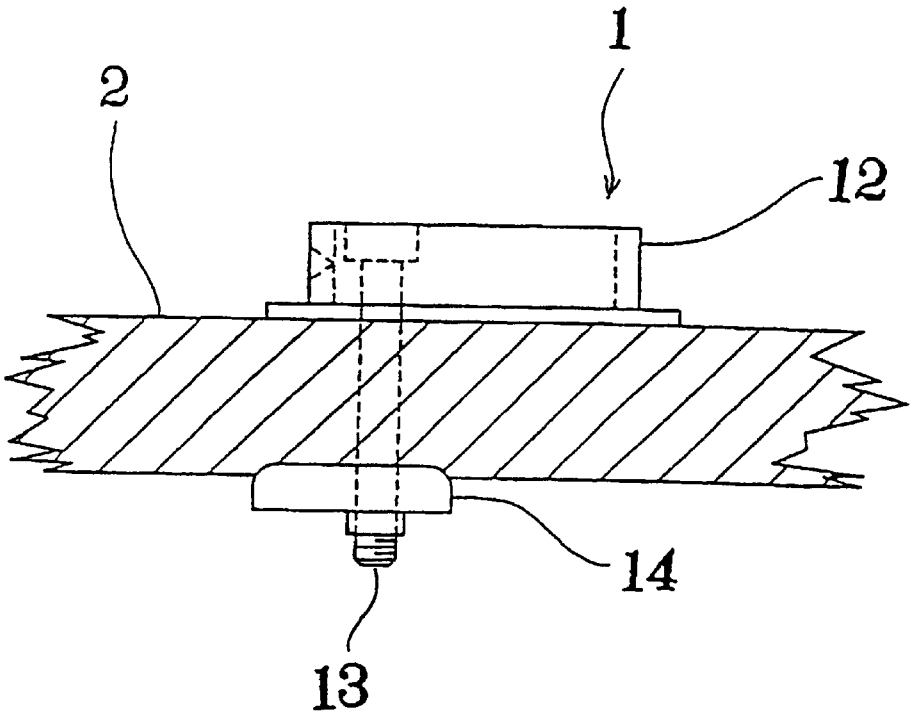
FIG. 27 is a side view showing another embodiment of a tightening member according to the principles of the present invention.

FIG. 27 is a view showing another embodiment of a tightening member 14. In this embodiment, the upper surface of the tightening member 14 is formed curved.

So, when holding the base plate 2 between the tightening members 14 and the support seat 12, the shearing force occurring at the base plate 2 is relieved or mitigated by the rounded edge portion of the upper surface of the tightening member 14.

In this manner, it is possible to prevent the base plate 2 from being damaged or broken when being mounted with the faucet support member 1.

Figure 28:
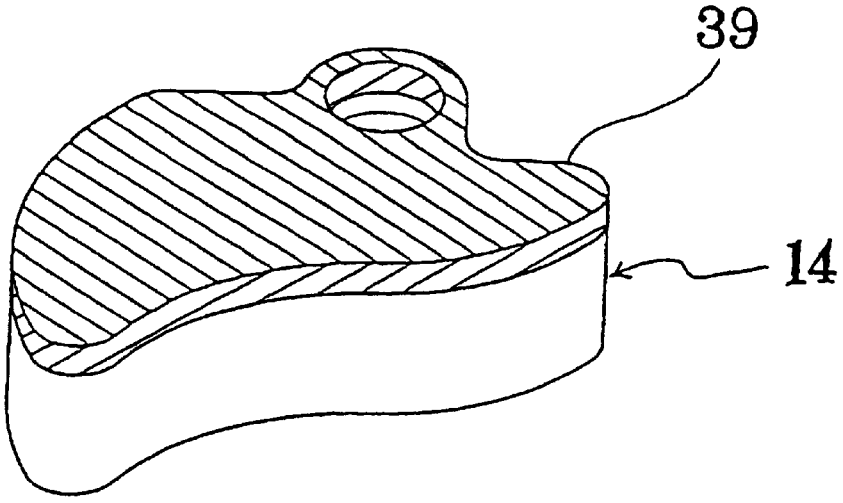
FIG. 28 is a side view showing another embodiment of a tightening member according to the principles of the present invention.

FIG. 28 shows another embodiment of a tightening member 14. In this embodiment, a buffer member 39 made of, for example, sponge, cloth, etc., is stuck or adhered onto the upper surface of the tightening member 14.

In this manner, it is also possible to relieve or mitigate the shearing force occurring at the base plate 2 by attaching the buffer member 39 on the upper surface of the tightening member 14, thereby preventing breakage from the tightening member 14.

Figure 34:
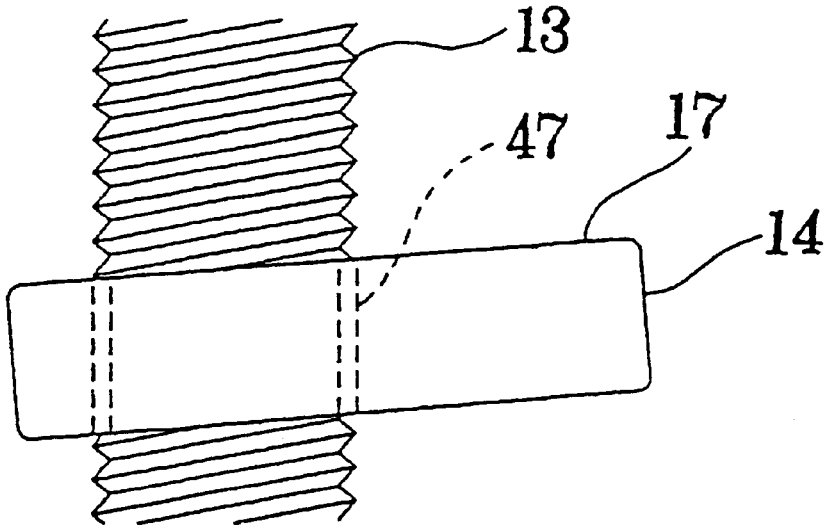
FIG. 34 is a side view showing another embodiment of a tightening member according to the principles of the present invention.

FIG. 34 shows another embodiment of a tightening member 14. In this embodiment, a female screw portion 47 is formed in an inclined manner in the base end portion (the portion in which connector 13 is inserted) of tightening member 14 having a rectangular shape in a plane view thereof. Therefore, the upper surface of the tightening member 14 is sloped upward from the base end portion to the front end portion thereof, when the female screw portion 47 of the tightening member 14 is screwed onto the connector 13.

Figure 36A:
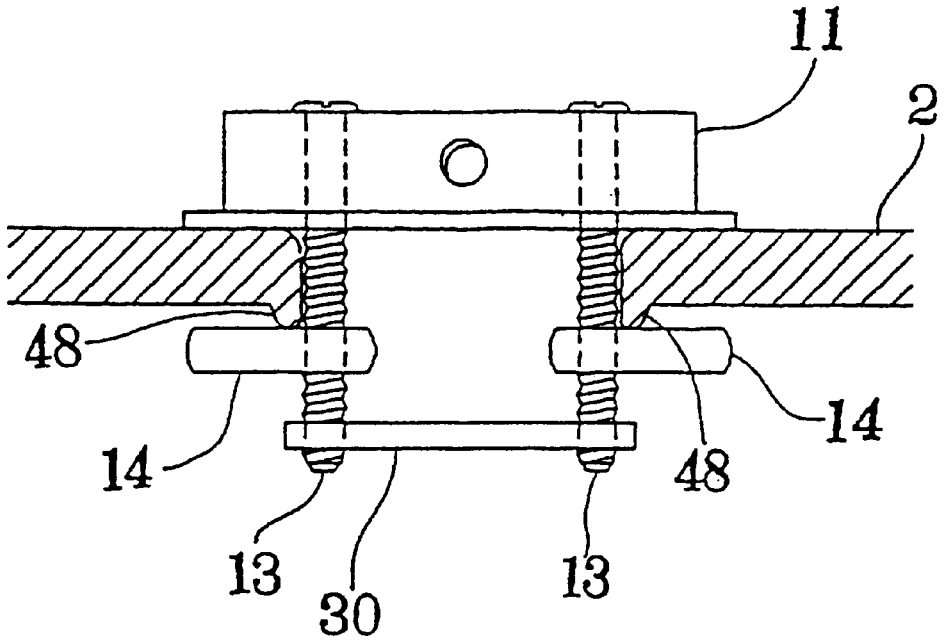
FIGS. 36(A) and (B) are side views showing a condition of mounting a faucet support member using the tightening members shown in FIGS. 34 and 35, respectively.
Figure 36B:
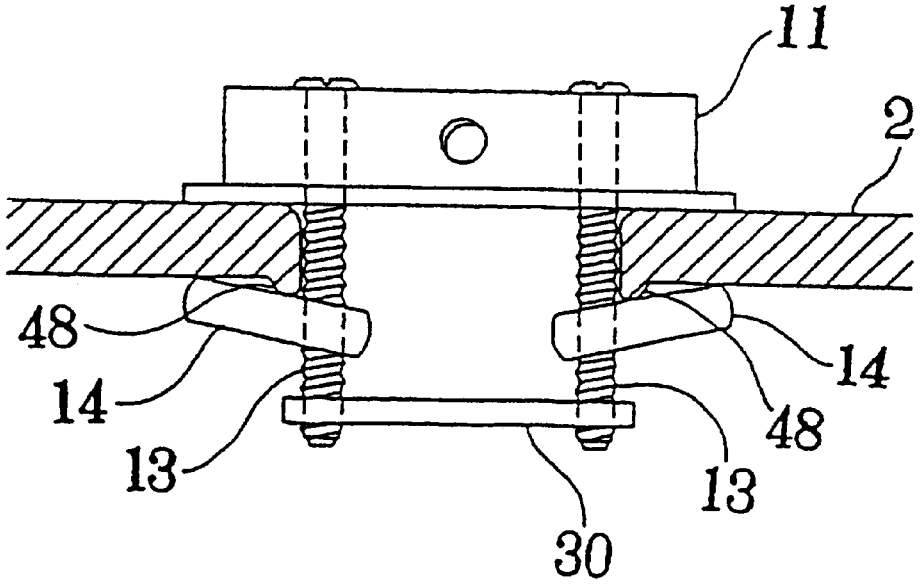

For that reason, as was mentioned previously, in the case where the tightening member 14 is mounted onto the connector 13 at right angles, as shown in FIG. 36(A), if a protruding portion 48, such as a fin or burr of ceramics, etc., is formed at a lower periphery portion of the mounting hole 4 in the base plate 2, only the protruding portion 48 is gripped by the bottom surface of the support seat 12 and the upper surfaces of the tightening members 14. Therefore, the strength in mounting the support seat 12 is decreased. However, according to the present embodiment, the upper surface of the tightening member 14 is inclined from the base end portion to the front end portion. So, as shown in FIG. 36(B), not only the protruding portion 48, but also the periphery portion of the mounting hole 4 is held between the bottom surface of the support seat 12 and the upper surfaces of the tightening members 14. Therefore the strength in mounting the support seat 12 can be increased.

Figure 35:
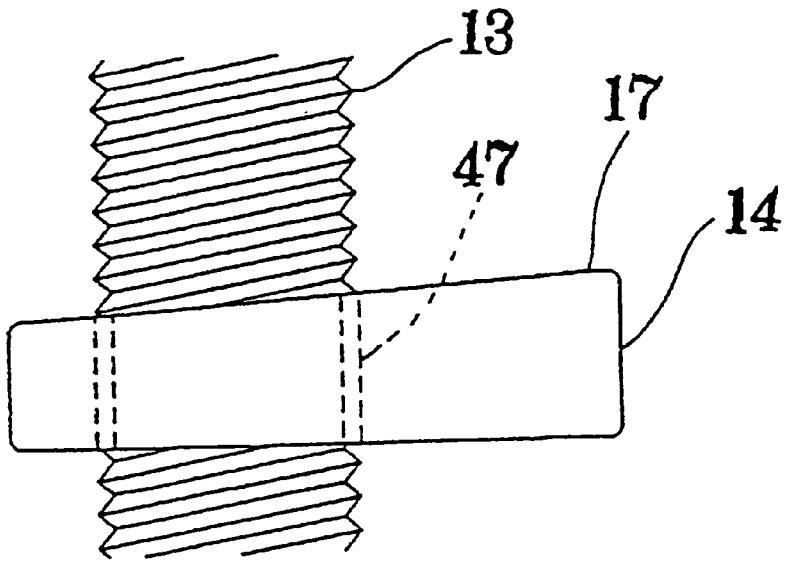
FIG. 35 is a side view showing another embodiment of a tightening member according to the principles of the present invention.

FIG. 35 is a view showing another embodiment of the tightening member 14. In this embodiment, at the base end portion of the tightening member 14, having a trapezoidal shape in a side view thereof, the female screw portion 47 is formed so as to incline the upper surface of the tightening member 14, while being orthogonal to the lower surface thereof, so that the upper surface of the tightening member 14 is inclined from the base end portion to the front end portion thereof when the tightening member 14 is screwed onto the connector 13 at the female screw portion 47.

With this, it is possible to grip the base plate 2 between the bottom surface of the support seat 12 and the front end portions of the tightening members 14 tightly, thereby increasing the strength in mounting of the support seat 12.

Figure 29:
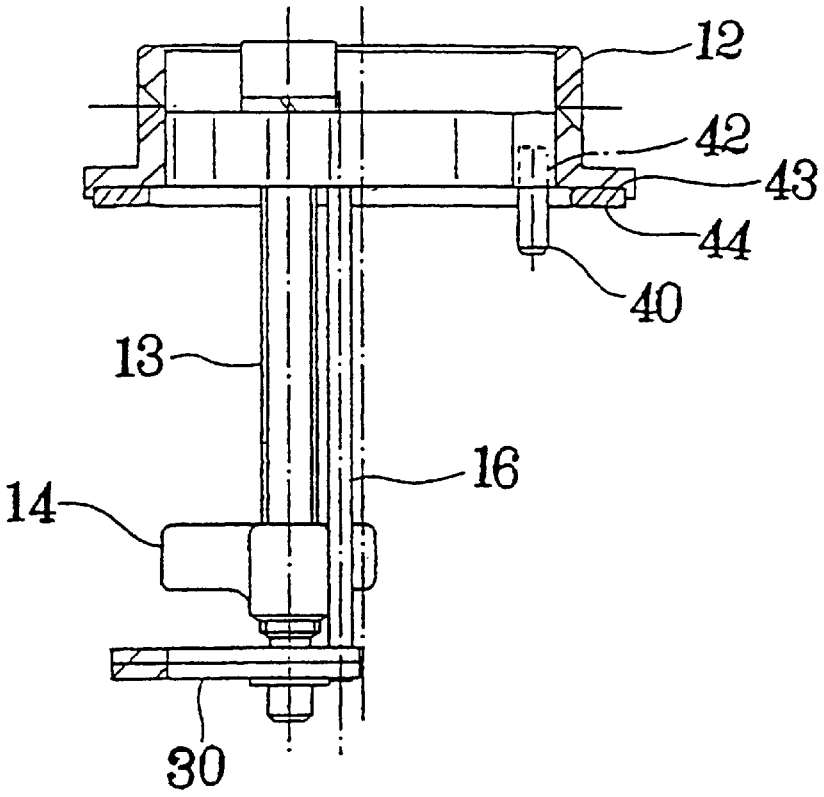
FIG. 29 is a side view showing another embodiment of a support seat according to the principles of the present invention.

FIG. 29 is a view showing another embodiment of the support seat 12. In this embodiment, an insertion bore 42 is drilled in the bottom surface of the support seat 12, so that a pin-like guide member is freely detachable from the same insertion bore 42.

The guide member 40 is constructed so that the outer periphery surface thereof abuts on the inner periphery surface of the mounting hole 4 when the support seat 12 is mounted onto the base plate 2.

A plurality of insertion bores 42 are formed at different distances from a substantially central position of the support seat 12, so that the guide member 40 can be inserted into insertion bore 42, and can be changed depending upon the size, such as the inner diameter, etc., of the mounting hole 4.

In this manner, since on the support seat 12 the guide member 40 is provided, which abuts the inner periphery surface of the mounting hole 4 when mounting the support seat 12 onto the base plate 2, it is possible to mount the support seat 12 onto the base plate 2 easily, thereby improving the workability thereof.

The guide member 40 is constructed so as to be detachable from the support seat 12. Therefore by removing the guide member 40 from the support seat 12, it is still possible to mount the support seat 12 onto various sizes of mounting holes 4, thereby widening the utility of the support seat 12.

Further, with a construction such that the position of insertion of the guide member 40 can be adjusted depending upon the size of the mounting hole 4, by adjusting the position of insertion of the guide member 40 it is also possible to mount the support seat 12 into various sizes of mounting holes 4, thereby widening the utility of the support seat 12.

Figure 30:
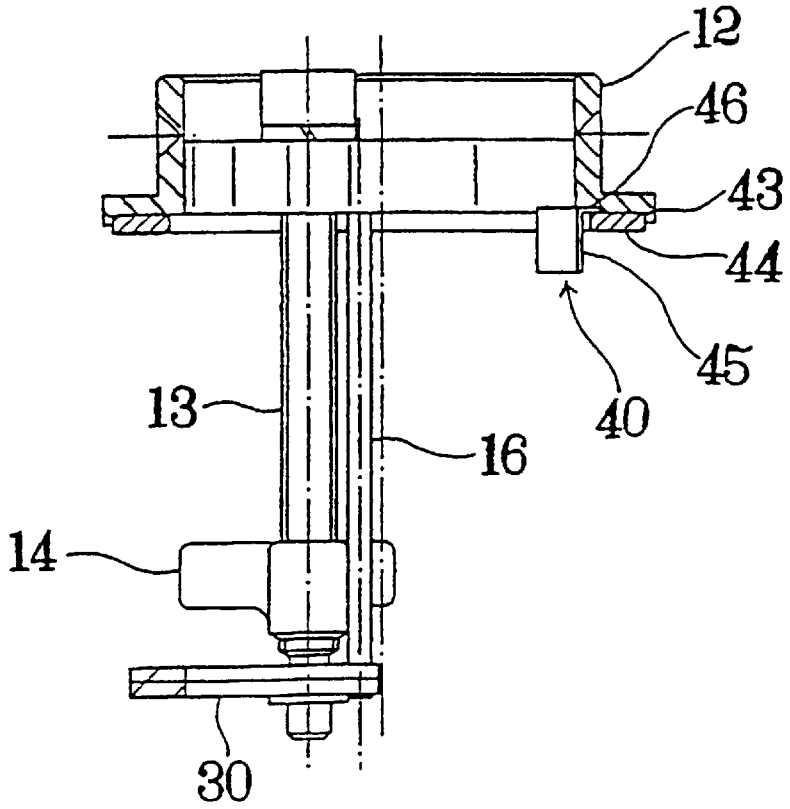
FIG. 30 is a side view showing yet another embodiment of a support seat according to the principles of the present invention.
Figure 31:
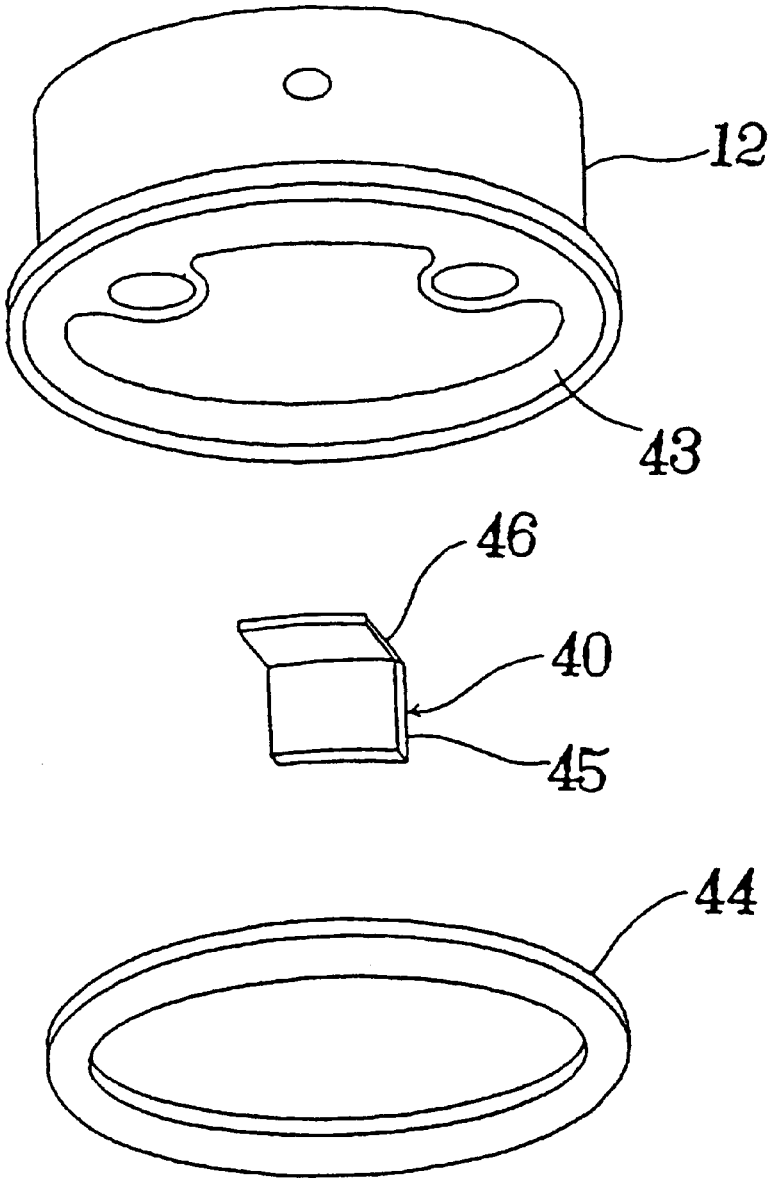
FIG. 31 is an exploded perspective view of the support seat shown in FIG. 30.

FIGS. 30 and 31 are views showing another embodiment of the guide member 40. In this embodiment, a ring-like packing receiving concave portion 43 is formed, on the bottom surface of the support seat 12 encircling the opening portion 6, so that a ring-like packing 44 can be inserted into the same packing receiving concave portion 43. A brim portion 46 is formed at the upper end of the guide member 40 having a side wall 45 having a substantially arc-like shape in a plane view thereof. The guide member 40 can then be mounted, detachably, onto the support seat 12 by holding the brim portion 46 of the guide member 40 between the bottom surface of the support seat 12 and the packing 44.

The guide member 40 is structured so that the side wall 45 of the guide member 40 abuts the inner periphery surface of the mounting hole 4.

With this structure, it is also possible to mount the support seat 12 on the base plate 2 easily, thereby improving the workability thereof. Further, by removing the guide member 40 from the support seat 12, it is also possible to mount the support seat 12 even on mounting holes 4 of various sizes, thereby widening the utility of the support seat 12.

Figure 32A:
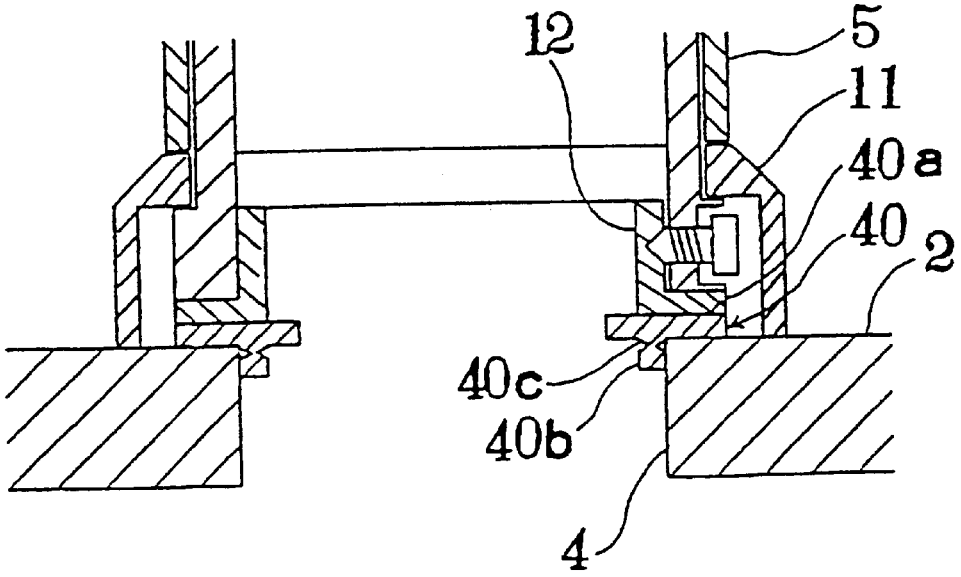
FIGS. 32(A) and (B) are side views showing another embodiment of a support seat according to the principles of the present invention.
Figure 32B:
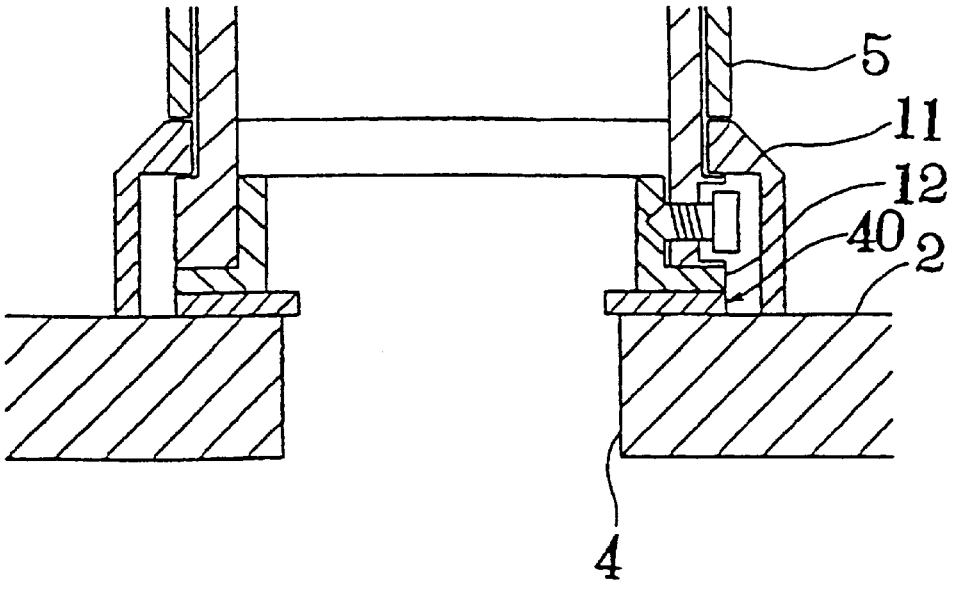

FIGS. 32(A) and (B) are views showing another embodiment of the guide member 40. The same guide member 40 comprises a main body 40*a* of the guide member which has a thin plate-like and ring-like shape, and a guide body 40*b* which protrudes downward from the bottom surf ace of the guide member main body 40*a* and is removable therefrom via score or notch 40*c*.

In a case where the mounting hole 4 of the base plate 2 is of a predetermined size, as shown in FIG. 32(A), the guide member 40 is used under the condition that the guide 40*b* is connected with the guide member main body 40*a*. Otherwise, in a case where the size of the mounting hole 4 of the base plate 2 is changed due to a design change, etc., as shown in FIG. 32(A), the guide body 40*b* can be separated from the guide member main body 40*a*.

In this manner, since the guide body 40*b* is formed to be removable from the guide member main body 40*a,* it is possible to mount the support seat 12 on various sizes of mounting hole 4, by removing the guide body 40*b* from the guide member main body 40*a,* thereby widening the utility of the guide member 40.

Next, an explanation will be given on the method for fixing the base end portion 5 of the faucet 3 onto the faucet support member 1.

Figure 20:
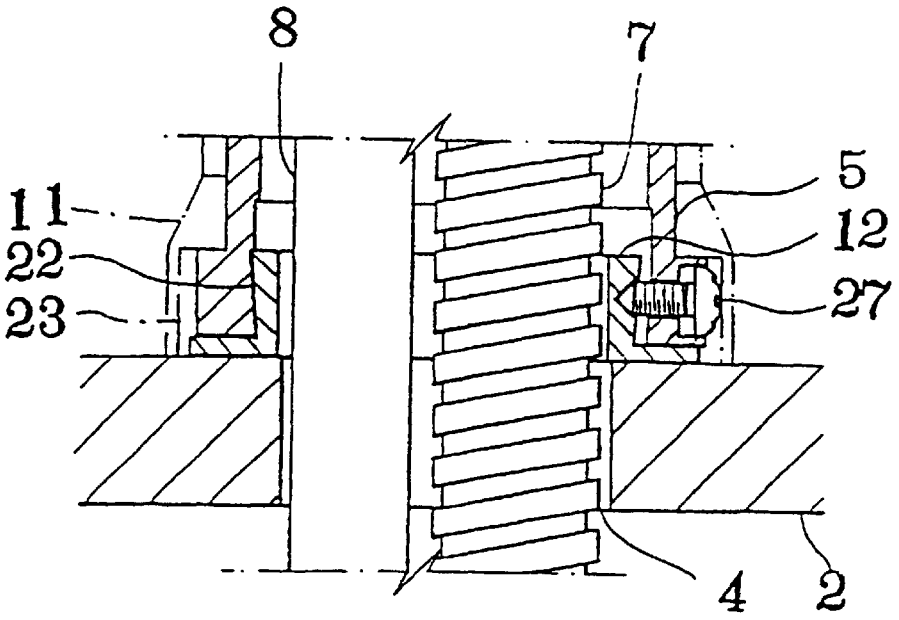
FIG. 20 is a side cross-section view of the structure for mounting the faucet support member.
Figure 21:
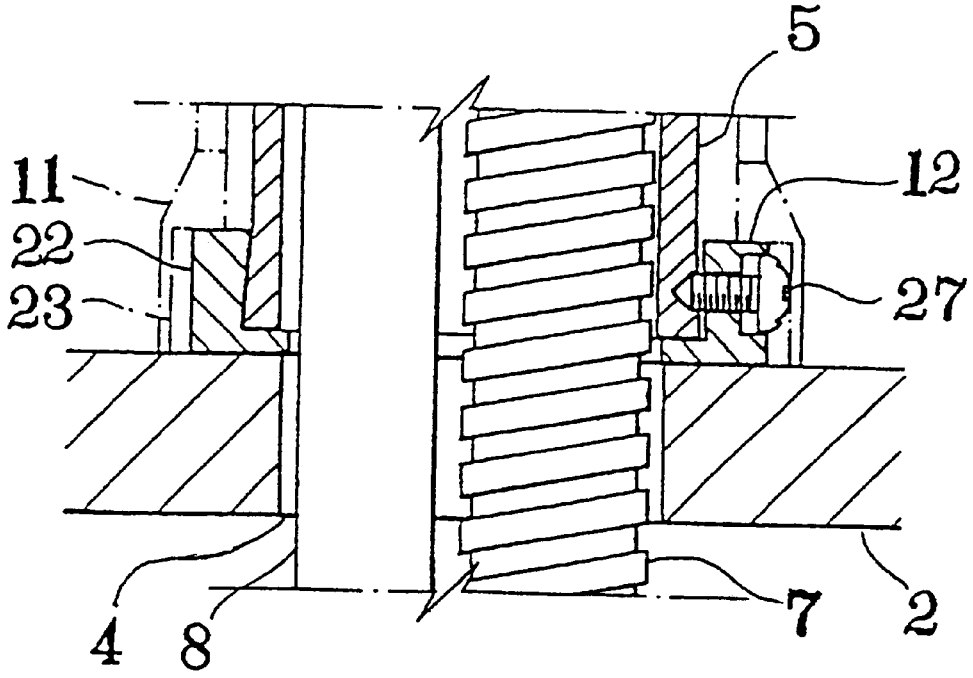
FIG. 21 is a side cross-section view of another embodiment of the structure for mounting the faucet support member.

The faucet 3 is fixed by mounting the base end portion 5 thereof to the support seat 12 mentioned above. Namely, as shown in FIG. 20, the support seat 12 is mounted on the base plate 2 in the manner mentioned above, thereon the base end portion 5 of the faucet 3 is mounted around the outer periphery of a cylindrical portion 22 of the same support seat 12, while a ring body 23 is loosely inserted around the outer periphery of the same base end portion 5 rotatably or pivotably. Further, around the same ring body 23 a cover ring 11 is loosely inserted, rotatably or pivotably. However, as shown in FIG. 21, the base end portion 5 of faucet 3 may be mounted inside the inner periphery of the cylindrical portion 22 of the support seat 12.

Figure 18A:
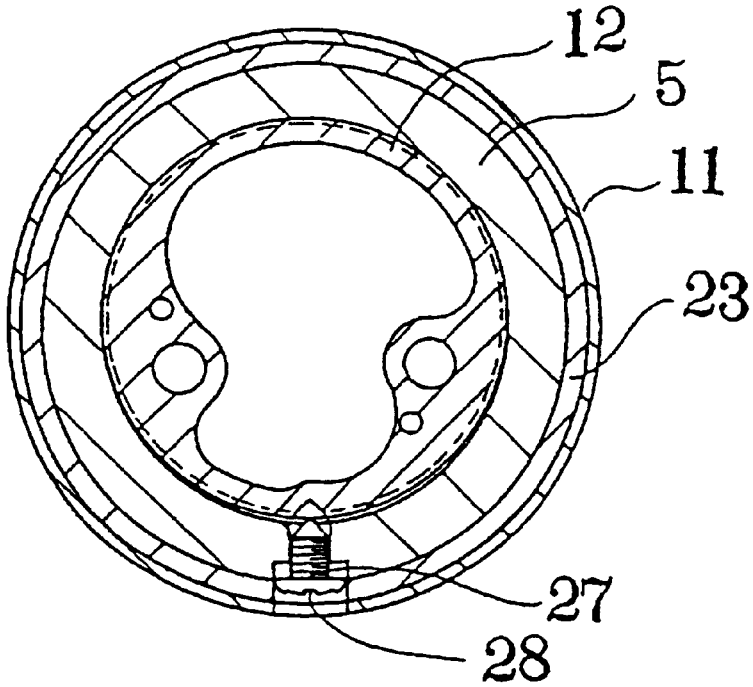
FIGS. 18(A) and (B) are plane cross-section views showing the structure for mounting the faucet support member.

As shown in FIG. 18(A), under the condition that a female screw bore 24 drilled into the base end portion 5 of the faucet 3 is coincident with penetrating bores 25 and 26 drilled on the ring body 23 and the cover ring 11, respectively, a mounting screw as a fixing member 27 is screwed into the female screw bore 24, thereby fixing the base end portion 5 of the faucet 3 onto the support seat 12.

Figure 18B:
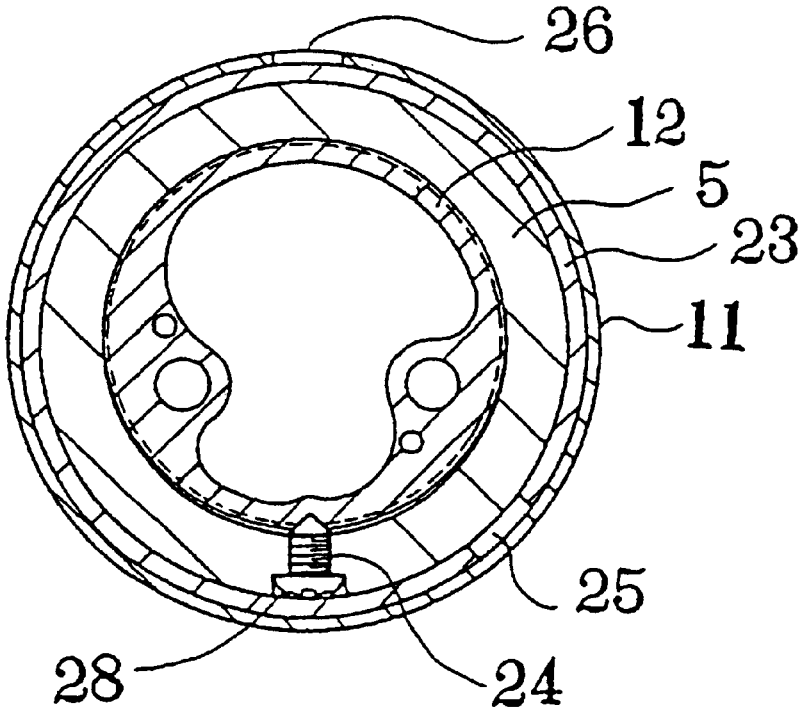
Figure 19:
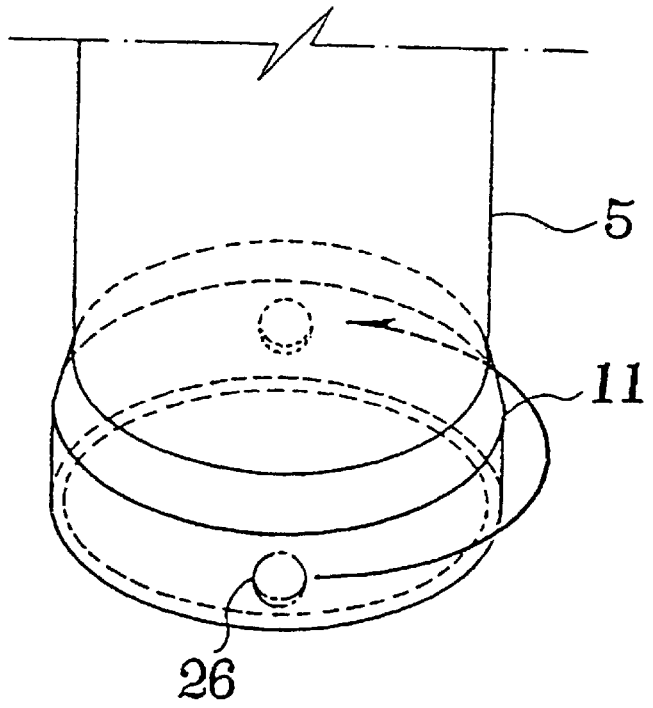
FIG. 19 is a perspective view of the structure for mounting the faucet support member.

As shown in FIGS. 18(B) and 19, after screwing the fixing member 27, the head portion 28 of the fixing member 27 is hidden by turning or rotating the ring body 23 and the cover ring 11. Accordingly, the head portion 28 of the fixing member 27 abuts against the inner periphery surface of the ring body 23 even if the fixing member 27 is loosened, so that the fixing member 27 is not be removed. However, the fixing member 27 may be one which has no such head portion 28 therewith, but formed with, for example a "–" groove, a "+" groove, or a hexagon bore on the end surface thereof for rotation. In this case, it is possible to make the outer diameter of the cover ring 11 smaller by the thickness of the head portion 28 of the fixing member 27.

Therefore, it is possible to make the fixing of the faucet 3 sound, and to prevent the fixing member 27 from being unduly loosened or lost.

Figure 33:
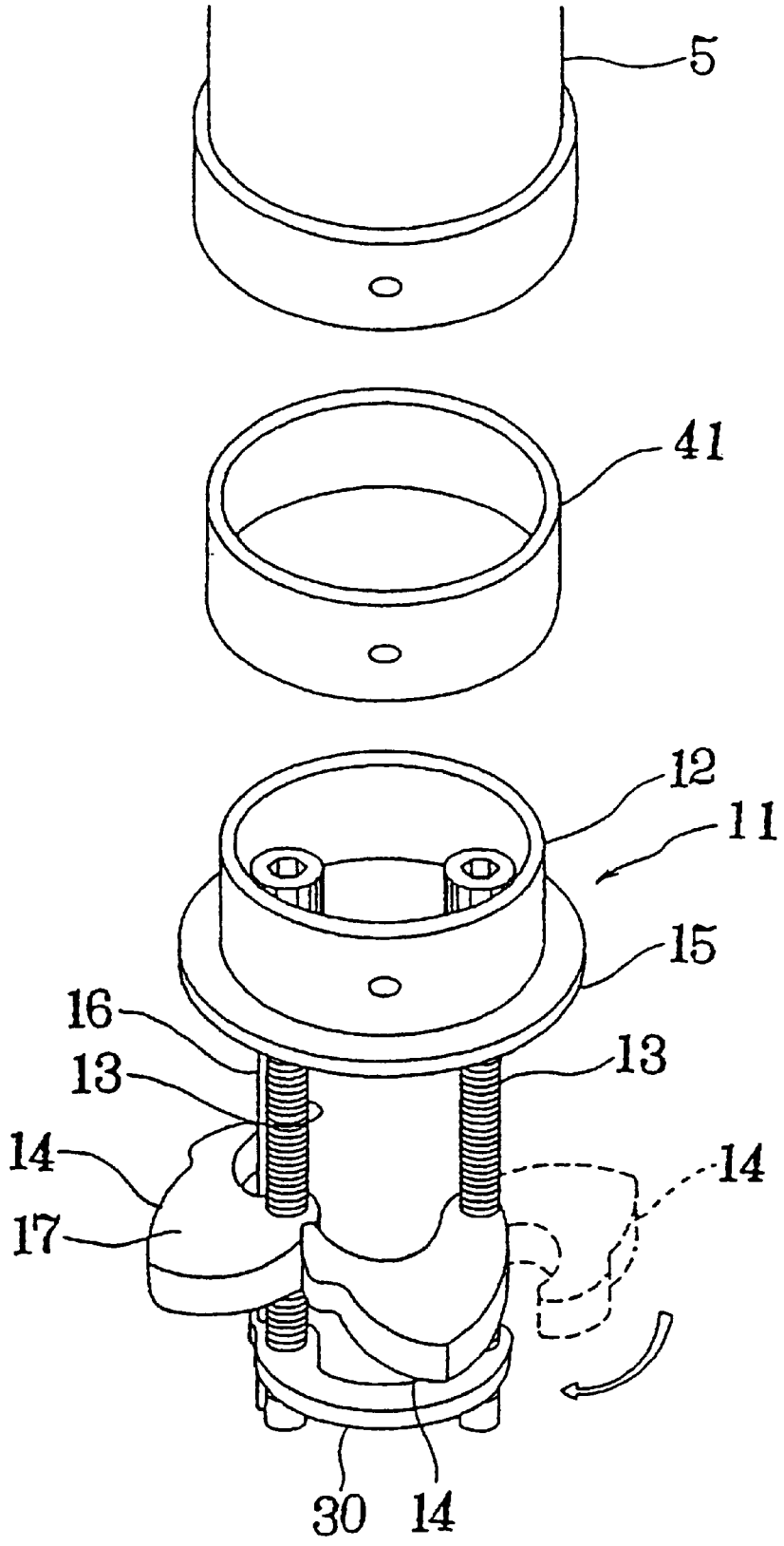
FIG. 33 is an exploded perspective view of another embodiment of the structure for mounting a faucet support member according to the principles of the present invention.

FIG. 33 is a view showing another embodiment of the structure of the fixing portion of the faucet support member 1, wherein a ring-like adopter member 41 is provided between the support seat 12 and the base end portion 5 of the faucet 3.

With the application of the adopter member 41, being depending upon the shape and sizes of the faucet 3, it is possible to mount faucets of different sizes thereof onto the same support seat 12. In the present embodiment, an adopter member 41 having an arc like outer side surface is used. However another one having a rectangular side surface depending upon the shape of the faucet 3 may be used.

Accordingly, even in a case where the kind of the faucet 3 is altered, there is no necessity to exchange the support seat 12, thereby widening the utility of the support seat 12.

Furthermore, in the present embodiment, one of the tightening members 14 is made to function as the turning prevention body 16 for preventing the other tightening member 14 from being turned.

Namely, when the connector 13 at the left-hand side is turned in a clock-wise direction, the tightening member 14 at the left-hand side is also turned or rotated therewith. However the tightening member 14 at the left-hand side abuts on the turning prevention body 16 when tightening member 14 at the left-hand side rotates about a half revolution, therefore it cannot rotate any more. If the connector 13 is turned further in a clock-wise direction under such a condition, the tightening member 14 is lifted up along the connector 13, thereby bringing about the gripping of the base plate 2 between the bottom surface 15 of the support seat 12 and the upper surfaces 17 of the tightening members 14.

Also, when the connector 13 at the right-hand side is turned or rotated in a clock-wise direction, the tightening member 14 at the right-hand side is also turned therewith, however the tightening member 14 at the right-hand side abuts on the connector 14 at the left-hand side when it rotates about a half revolution, thereby being unable to rotate further. If the connector 13 is turned further in a clock-wise direction under that condition, the tightening member 14 is lifted up along the connector 13, thereby bringing about the gripping of the base plate 2 between the bottom surface 15 of the support seat 12 and the upper surfaces 17 of the tightening members 14.

In this manner, there is no necessity to provide the turning prevention body 16 separately, thereby attaining a decrease in the number of parts thereof.

In the present embodiment, the sizes of the tightening members 14 are made large so that one of the tightening members 14 abuts on the other, thereby also making it possible to reinforce the strength in mounting by the tightening members 14. However, in the present embodiment, the two (2) tightening members 14 are disposed one on top of the other, under the condition that the front ends thereof are directed inward, thereby allowing them to be inserted into the mounting hole 4 of the base plate 2.

INDUSTRIAL APPLICABILITY

According to the present invention, the faucet support member comprises the turning prevention body(s) for preventing the tightening members from being turned, under the condition that the tightening members open beyond the opening diameter. The tightening members move upward, under the condition that the tightening members open beyond the opening diameter of the mounting hole, by turning the connectors. As a result of this, the faucet support member is constructed so that the base plate is held between the bottom surface of the support seat and the upper surfaces of the tightening members. Such faucet support member can be mounted from the upper surface side of the base plate, easily and smoothly, thereby enabling the improvement of the workability and safety thereof.

Further, under the condition that the support seat is mounted at a predetermined position on the base plate, with a plurality of connectors or turning prevention bodies being disposed, or arranged at the positions where the outer surface of the connectors or the turning prevention bodies abut on the inner periphery surface of the mounting hole, it is possible to make the connectors or the turning prevention bodies function as the positioning members when mounting the faucet support member, thereby further improving the workability, when mounting the faucet support.

Also, when the turning prevention bodies are mounted detachably onto the tightening members and/or the support seat, it is possible to separate the turning prevention bodies from the tightening members and the support seat when transporting the faucet support member, while to attach the turning prevention bodies onto the tightening members and the support seat when mounting the faucet support member, thereby enabling them prevention of the turning prevention bodies from being broken when transporting the faucet support member.

Since the cover ring with the penetrating bore, in which the fixing member for fixing the base end portion of the faucet onto the support seat can be inserted, is rotatably mounted around the outer periphery of the above-mentioned support seat, the fixing member can be covered with the periphery wall of the cover ring by rotation thereof, after fixing the base end portion of the faucet onto the support seat by inserting the fixing member through the penetrating bore. Therefore it is possible to make the fixing of the faucet sound, and also to prevent the fixing member from being unduly loosened or lost.

With the provision of the spacer on the faucet support member(s), it is possible to keep the distance between the connectors constant, thereby enabling the tight gripping of the base plate between the support seat and the tightening members, as well as to perform the work of mounting the faucet support member smoothly.

Since the connectors are made pivotable or rotatable Independently, the connectors neighboring each other do not interfere with each other, and since there is no order or sequence In tightening thereof, improvement in the workability thereof is enabled.

With the provision of two (2) tightening members, wherein the inner side surfaces of both the tightening members abut on each other under the condition that the front ends of the both tightening members are directed inward, the area of the upper surfaces of both tightening members are enlarged as much as possible, thereby maximizing the tightening power when mounting the faucet support member onto the base plate.

With the forming of the resistance portion on the upper surface of the tightening members, the resistance portion lies between the tightening members and the base plate to bite into the base plate, thereby creating a resistance when the tightening members are screwed after being tightened, so as to hold the base plate tightly. Therefore it is possible to mount the faucet support member onto the base plate tightly.

With the forming of the curved surfaces on the upper surfaces of the tightening members or the mounting of the buffer members on the upper surfaces of the tightening members, it is possible to mitigate the shearing power, which is generated at the base plate on the upper surface of the tightening members when gripping the base plate between the tightening members and the support seat, thereby preventing breakage or damage to the base plate.

With the provision of the guide members on the above-mentioned support seat, which abut on the inner periphery surface of the mounting hole when mounting the support seat onto the base plate, it is possible to mount the support seat onto the base plate easily, thereby improving the workability thereof.

With such a construction that the guide members are detachable from the support seat, it is possible to mount the support seat onto mounting holes of different sizes by separating the guide member from the support seat, thereby widening the utility of the support seat.

Constructing the guide member with the guide member main body and the guide body, so that the guide body can be removed from the guide member main body, it is possible to mount the support seat onto mounting holes of different sizes by separating the guide member from the support seat, thereby widening the utility of the support seat.

With such a construction that the guide member can be adjusted at the mounting position thereof depending upon the sizes of the mounting holes, it is also possible to mount the support seat onto mounting holes of different sizes by adjusting the mounting position of the guide member depending upon the size of the mounting hole, thereby also widening the utility of the support seat.

With the provision of the adapter member between the support seat and the base end portion of the faucet, it is possible to mount faucets of different sizes onto the support seat. And there is no necessity to exchange the support seat even when the faucet is changed to another kind, thereby also widening the utility of the support seat.

While the base end portions of the tightening members are mounted onto the connectors, and the upper surfaces at the front end portions thereof are formed to be inclined toward the base plate, it is possible to tightly grip the base plate between the bottom surface of the support seat and the front end portions of the tightening members, even if a fin or burr of ceramics is formed at the mounting hole, thereby improving the mounting strength of the support seat.

What is claimed is:

1. A faucet support member configured to releasably fix a faucet in a mounting hole that is formed in a base plate, the faucet having at least one of a base end portion and a handy spray, the faucet support member comprising:

a support seat provided to support the base end portion of the faucet, the support seat having a bottom surface configured to engage the base plate when the faucet support member is releasably fixed to the base plate;

a plurality of connectors configured to extend through the support seat and to extend from the bottom surface of the support seat;

a plurality of tightening members configured to be movable along the plurality of connectors, each tightening member having an upper surface configured to engage the base plate when the faucet support member is fixed to the base plate, wherein the plurality of tightening members are pivotally attached to the plurality of connectors such that front end portions of the plurality of tightening members are directed inward when the plurality of tightening members are inserted through the mounting hole, and the front end portions of the tightening members are rotated to be directed outward when the tightening members are opened beyond a diameter of the mounting hole; and a plurality of turning prevention members operatively engaging the plurality of connectors and configured to prevent the plurality of tightening members from being turned when the plurality of tightening members open beyond the diameter of the mounting hole, wherein the plurality of tightening members are moved toward the bottom surface of the support seat to grip the base plate between the bottom surface of the support seat and the upper surface of each tightening member when the plurality of tightening members open beyond the diameter of the mounting hole, thereby supporting the faucet on the base plate.

2. A faucet support member as defined in claim 1, wherein said turning prevention members are provided on said support seat.

3. A faucet support member as defined in claim 1, wherein said turning prevention members are provided on said tightening members.

4. A faucet support member as defined in any one of claims 1 to 3, wherein a plurality of connectors are positioned so that the external side surfaces of said connectors are in contact with the internal surface of said mounting hole when said support seat is fixed at a predetermined position.

5. A faucet support member as defined in any one of claims 1 to 3, wherein said plurality of tuning members are positioned so that an external side surface of said each turning prevention member engages with an internal surface of said mounting hole when said support seat is fixed at a predetermined position.

6. A faucet support member as defined in any one of claims 1 to 3, wherein connectors are positioned so that the external side surfaces of said connectors are in contact with the internal surface of said mounting hole when said support seat is fixed at a predetermined position, while turning prevention members are positioned so that the external side surfaces of said turning prevention members are in contact with the internal surface of said mounting hole when said support seat is fixed at a predetermined position.

7. A faucet support member as defined in any one of claims 1 to 3, wherein said plurality of turning prevention members are detachable from said plurality of connectors.

8. A faucet support member as defined in claim 2 or 3, wherein said plurality of connectors are bolts, and said plurality of tightening members are screwed onto said bolts.

9. A faucet support member as defined in any one of claims 1 to 8, wherein in an opening portion of said support seat a convex portion is formed for holding a water conducting pipe which is inserted in said support seat.

10. A faucet support member as defined in claim 9, wherein said connectors are positioned on said convex portion.

11. A faucet support member as defined in any one of claims 1 to 3, wherein said plurality of tightening members are constructed so that the plurality of tightening members inhibit said water conducting pipe from being inserted into said opening portion of said support seat when the front ends thereof are directed inward.

12. A faucet support member as defined in any one of claims 1 to 3, further comprising:

a cover ring pivotally mounted on an outer periphery of said support seat, said cover ring having a penetration hole formed in a peripheral wall of said cover ring; and a fixing member configured to be inserted into said penetration hole to fix the base end portion of said faucet onto said support seat, wherein said cover ring covers said fixing member with the peripheral wall thereof so as to prevent said fixing member from being moved in a loosening direction thereof.

13. A faucet support member as defined in claim 1, wherein a plurality of connectors are provided on said support seat being separated at a distance, and a spacer is provided on each set of connectors for maintaining the distance therebetween.

14. A faucet support member as defined in claim 13, wherein said spacer is provided on each set of connectors in a detachable manner.

15. A faucet support member as defined in claim 14, wherein said spacer is provided on said support seat in a detachable manner.

16. A faucet support member as defined in claim 13, wherein said plurality of connectors are two bolts.

17. A faucet support member as defined in claim 13, wherein said plurality of connectors are two bolts, and bolt insertion holes are drilled in said spacer, so as to penetrate said bolts through said bolt insertion holes, and nuts are screwed onto said bolts.

18. A faucet support member as defined in claim 13, wherein an insertion bore is drilled in said spacer for inserting said turning prevention members therein.

19. A faucet support member as defined in claim 1, wherein said plurality of connectors are provided on said support seat being separated by a distance and being pivotable independently.

20. A faucet support member as defined in claim 1, wherein two (2) tightening members are provided and inner surfaces of said tightening members are in contact with each other when the front ends of said tightening members are directed inward.

21. A faucet support member as defined in claim 1, wherein a resistance portion is formed on an upper portion of each of said tightening members, and said resistance portion lies between said tightening members and said base plate so that they provide resistance when said tightening members are turned after being tightened.

22. A faucet support member as defined in claim 1, wherein a buffer member is attached on an upper portion of said tightening members.

23. A faucet support member as defined in claim 1, wherein a curved surface is formed on an upper portion of said tightening members.

24. A faucet support member as defined in claim 1, wherein a guide member is provided on said support seat so that it is in contact with the inner periphery surface of the mounting hole when attaching said support seat onto said base plate.

25. A faucet support member as defined in claim 24, wherein said guide member is constructed so that it is detachable from said support seat.

26. A faucet support member as defined in claim 24, wherein said guide member is constructed with a main body and a guide body, and said guide body is detachable from said main body.

27. A faucet support member as defined in claim 24, wherein said guide member is constructed so that it is adjustable in a portion to be attached depending upon the size of said mounting hole.

28. A faucet support member as defined in claim 1, wherein an adapter member lies between said support seat and the base end portion of said faucet.

29. A faucet support member as defined in claim 1, wherein the upper surface of the front end portion of said tightening member is inclined toward said base plate while being attached with said connectors on the base end portion thereof.

30. A faucet support member as defined in any one of claims 1 to 3, wherein said support seat is detachably engaged with said base plate.

31. A faucet support member configured to releasably fix a faucet in a mounting hole that is formed in a base plate, the faucet having at least one of a base end portion and a handy spray, the faucet support member comprising:

a support seat provided to support the base end portion of the faucet, the support seat having a bottom surface configured to engage the base plate when the faucet support member is releasably fixed to the base plate;

a plurality of connectors configured to extend through the support seat and to extend from the bottom surface of the support seat;

a plurality of tightening members configured to be movable along the plurality of connectors, each tightening member having an upper surface configured to engage the bottom surface of the base plate when the faucet support member is fixed to the base plate, wherein the plurality of tightening members are pivotally attached to the plurality of connectors such that front end portions of the plurality of tightening members are directed inward when the plurality of tightening members are inserted through the mounting hole, and the plurality of tightening members can open beyond a diameter of the mounting hole when the front end portions of the plurality of tightening members are directed outward; and a plurality of turning prevention members coupled to the plurality of connectors and configured to prevent the plurality of tightening members from being turned when the plurality of tightening members open beyond the diameter of the mounting hole, wherein the plurality of tightening members are moved toward the bottom surface of the support seat to grip the base plate between the bottom surface of the support seat and the upper surface of each tightening member when the plurality of tightening members open beyond the diameter of the mounting hole, thereby supporting the faucet on the base plate, wherein said plurality of connectors are bolts and said plurality of tightening members are screwed onto said bolts.

* * * * *